US012084268B2

(12) United States Patent
Wang et al.

(10) Patent No.: US 12,084,268 B2
(45) Date of Patent: Sep. 10, 2024

(54) BRACKET FOR MOUNTING AN ELECTRONIC DEVICE TO A SHIPPING CONTAINER

(71) Applicant: BlackBerry Limited, Waterloo (CA)

(72) Inventors: Enliang Wang, Kitchener (CA); Scott Leonard Dill, Paris (CA)

(73) Assignee: BlackBerry Limited, Waterloo (CA)

( * ) Notice: Subject to any disclaimer, the term of this patent is extended or adjusted under 35 U.S.C. 154(b) by 340 days.

(21) Appl. No.: 17/464,558

(22) Filed: Sep. 1, 2021

(65) Prior Publication Data

US 2023/0069312 A1 Mar. 2, 2023

(51) Int. Cl.
*B65D 90/48* (2006.01)

(52) U.S. Cl.
CPC ..... *B65D 90/48* (2013.01); *B65D 2590/0083* (2013.01)

(58) Field of Classification Search
CPC ..... B65D 90/48; B65D 2590/0083; B65D 2203/10; H05K 5/0204
See application file for complete search history.

(56) References Cited

U.S. PATENT DOCUMENTS 4,832,299 A 5/1989 Gorton et al.
5,757,269 A * 5/1998 Roth ..... E05B 45/083 292/DIG. 60
6,441,740 B1 * 8/2002 Brady ..... H01Q 19/106 340/572.7
6,975,224 B2 * 12/2005 Galley, III ..... G06Q 10/087 340/539.18
7,283,052 B2 * 10/2007 Bohman ..... B65D 90/00 340/693.9
7,315,246 B2 * 1/2008 Rajapakse ..... B65D 90/22 340/545.7

(Continued)

FOREIGN PATENT DOCUMENTS

DE 10 2009 019 354 A1 11/2010
EP 3 339 109 A1 6/2018

(Continued)

OTHER PUBLICATIONS

Extended European Search Report, European Patent Application EP 22 19 2912, dated Jan. 5, 2023, pp. 1-8.

(Continued)

*Primary Examiner* — Eret C McNichols
(74) *Attorney, Agent, or Firm* — Moffat & Co

(57) ABSTRACT

A bracket for affixing a device to a shipping container, the bracket having a base; a first arm and a second arm disposed on distal ends of the base; a first flange and second flange extending from the first arm and the second arm; a first affixing mechanism and a second affixing mechanism to affix the first flange and the second flange respectively to adjacent locking rods on the shipping container, said first affixing mechanism and second affixing mechanism allowing rotation of the locking rods; and a mounting mechanism on the base for mounting the device, wherein the base is configured to fit within a corrugation behind the adjacent locking rods, and at least one portion of the base is configured to contact the shipping container when the first flange and the second flange are behind the adjacent locking rods.

20 Claims, 19 Drawing Sheets

(56) References Cited

U.S. PATENT DOCUMENTS

| | | | | |
|---|---|---|---|---|
| 7,317,387 | B1 * | 1/2008 | Cova | B65D 90/008 340/539.1 |
| 7,339,482 | B2 * | 3/2008 | Jaeger | B65D 90/00 312/7.1 |
| 7,411,495 | B2 * | 8/2008 | Auerbach | B65D 79/02 340/568.2 |
| 7,538,672 | B2 * | 5/2009 | Lockyer | G08B 13/08 340/562 |
| 7,847,691 | B2 * | 12/2010 | Jaeger | B65D 90/00 340/545.1 |
| 8,797,161 | B2 * | 8/2014 | Aflalo | B65D 90/00 340/568.1 |
| 8,836,506 | B2 | 9/2014 | Jaeger et al. | |
| 2004/0066328 | A1 * | 4/2004 | Galley, III | G06Q 10/08 705/28 |
| 2005/0212671 | A1 * | 9/2005 | Auerbach | G07C 11/00 340/539.1 |
| 2007/0075074 | A1 * | 4/2007 | Jaeger | B65D 90/00 361/600 |
| 2007/0075075 | A1 * | 4/2007 | Jaeger | H01Q 1/42 220/1.5 |
| 2009/0135015 | A1 * | 5/2009 | Dobson | H04Q 9/00 340/572.9 |
| 2011/0018707 | A1 | 1/2011 | Dobson et al. | |
| 2017/0314732 | A1 | 11/2017 | Minn et al. | |
| 2021/0245951 | A1 * | 8/2021 | Ptochos | B65D 90/008 |
| 2023/0415961 | A1 * | 12/2023 | Sanchez-Olea | B65D 25/02 |

FOREIGN PATENT DOCUMENTS

| | | | | |
|---|---|---|---|---|
| FR | 2904458 | A1 | 2/2008 | |
| JP | 2001207706 | A | 8/2001 | |
| JP | 5793206 | B2 | 7/2015 | |
| WO | 2006/084255 | A2 | 8/2006 | |
| WO | WO-2007070736 | A2 * | 6/2007 | G06Q 10/08 |
| WO | WO-2010133980 | A1 * | 11/2010 | B65D 88/741 |
| WO | WO-2019120740 | A1 * | 6/2019 | B65D 90/22 |
| WO | WO-2020058873 | A1 * | 3/2020 | B65D 90/022 |
| WO | 2020/182604 | A1 | 9/2020 | |

OTHER PUBLICATIONS

"Smart Container Tracking Module", Flyer, Hirschmann Solutions, dated Jan. 21, 2016.

Product: The Enforcer Adjustable Door Lock, Raney's Truck Parts, dated Apr. 27, 2017, retrieved from https://web.archive.org/web/20170427164615/https:/www.raneystruckparts.com/the-enforcer-adjustable-door-lock/.

Product: Heavy Duty Cargo Door Lock, The Equipment Lock Company, dated Jan. 19, 2021, retrieved from https://web.archive.org/web/20210119175050/https:/equipmentlock.com/product/heavy-duty-cargo-door-lock/.

Canadian Intellectual Property Office (CIPO) Official Action for Application No. 3,170,226 dated Dec. 21, 2023, 4 pages.

* cited by examiner

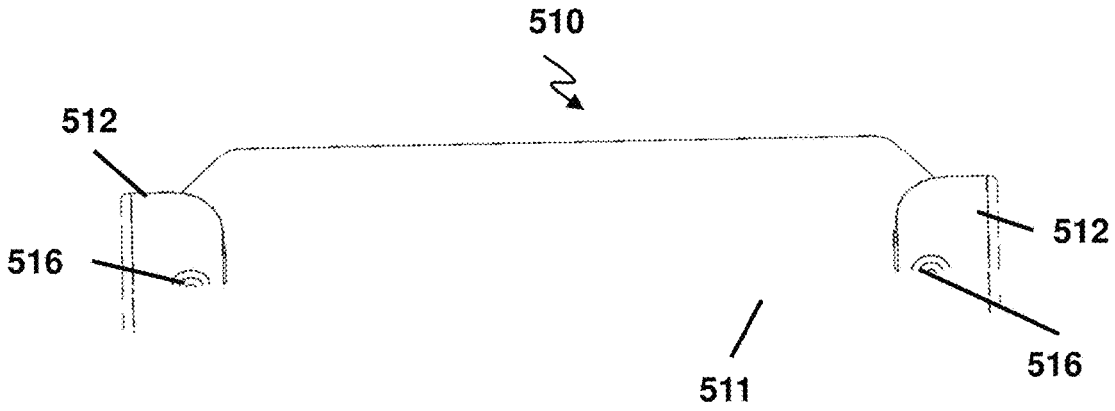
FIG. 21
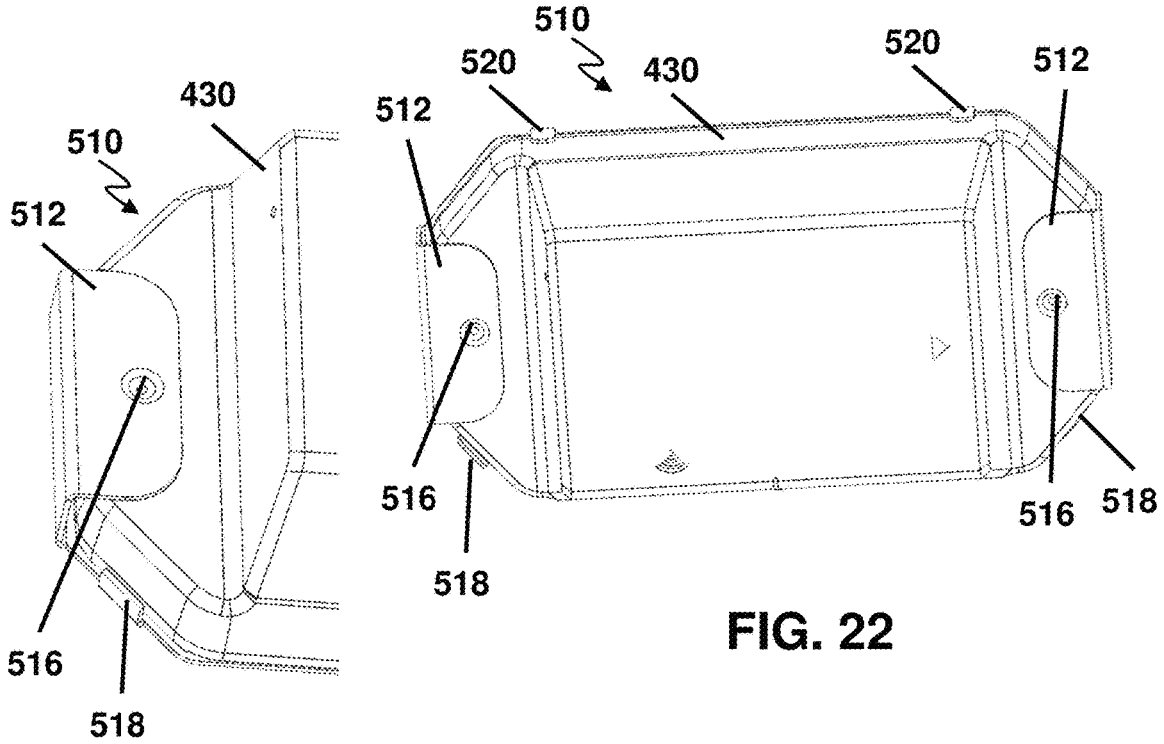
FIG. 22
FIG. 23

BRACKET FOR MOUNTING AN ELECTRONIC DEVICE TO A SHIPPING CONTAINER

FIELD OF THE DISCLOSURE

The present disclosure relates to electronic devices used in association with shipping containers, and in particular deals with mounting such electronic devices to the shipping containers.

BACKGROUND

Electronic devices may be associated with shipping containers for a variety of reasons. In some cases, the electronic devices may be associated with asset tracking. For example, such electronic device may include a Global Navigation Satellite System (GNSS) such as a Global Positioning System (GPS) receiver and log the location of the shipping container. In some cases, the electronic device may further include a transceiver for a communications subsystem, where the positioning of the container is reported and may be tracked at a central location. In some cases, the electronic device may simply include a transceiver for a communication subsystem without a GPS for sending updates or responding to pages from other devices. In some cases, the electronic device may include sensors and be used for loss mitigation or insurance dispute resolution, for example by logging events or providing reports when a shipping container door is opened. In some cases, electronic devices may include cameras for capturing images when motion is detected or when signals are received to record a vicinity. Other uses for electronic devices for shipping containers are possible.

Conventional ways to mount an electronic device to a shipping container include screw mounting and welding. Both could damage the container, and the implementation of both processes is difficult. Specifically, drilled holes are required if using screws to mount the electronic device. A problem is that those holes could result in water leakage to the container, cause corrosion points, and the drilling is not an easy installation experience.

Electric welding is another method to mount such a device. Such welding is a more difficult process which requires welding equipment and techniques. Welding damages the coating of the container and could cause corrosion. Further, the welded device is non-removable, which becomes an issue for repair of the device or battery changing.

BRIEF DESCRIPTION OF THE DRAWINGS

The present disclosure will be better understood with reference to the drawings, in which:

FIG. 21 is a cross section of a further mount capable of being used with the embodiments of the present disclosure.

FIG. 22 is a front perspective view of the mount of FIG. 21.

FIG. 23 is an expanded view of one side of the mount of FIG. 21.

DETAILED DESCRIPTION OF THE DRAWINGS

The present disclosure provides a bracket for affixing a device to a shipping container, the bracket comprising: a base; a first arm and a second arm disposed on distal ends of the base; a first flange and second flange extending from the first arm and the second arm; a first affixing mechanism and a second affixing mechanism to affix the first flange and the second flange respectively to adjacent locking rods on the shipping container, said first affixing mechanism and second affixing mechanism allowing rotation of the locking rods; and a mounting mechanism on the base for mounting the device, wherein the base is configured to fit within a corrugation behind the adjacent locking rods, and at least one portion of the base is configured to contact the shipping container when the first flange and the second flange are behind the adjacent locking rods.

The present disclosure further provides a bracket for affixing a device to a shipping container, the bracket comprising: a base shaped to securely fit within a corrugation on the shipping container behind adjacent locking rods on the shipping container; a first affixing mechanism and a second affixing mechanism to affix the base to the shipping container, said first affixing mechanism and second affixing mechanism allowing rotation of the locking rods; and a mounting mechanism on the base for mounting the device.

In accordance with embodiments of the present disclosure, brackets are provided for mounting electronic devices to shipping containers. As used here in, a shipping container could be any container used in the transportation of products or goods. For example, in some embodiments, an International Organization for Standardization (ISO) intermodal container may be utilized with the embodiments of the present disclosure. Such containers are typically suitable for ship, rail and truck transportation. However, the present disclosure is not limited to such ISO containers.

Further, while the disclosure below teaches the mounting of electronic devices onto a bracket, in some cases the device being mounted to the shipping container may not be an electronic device but may be any other type of device or mechanism. Therefore, while the present disclosure is taught with regard to an electronic device being mounted to the bracket, other types of devices could equally be utilized with the brackets disclosed herein.

In the figures provided below, like elements are labeled with like numerals.

Figure 1A:
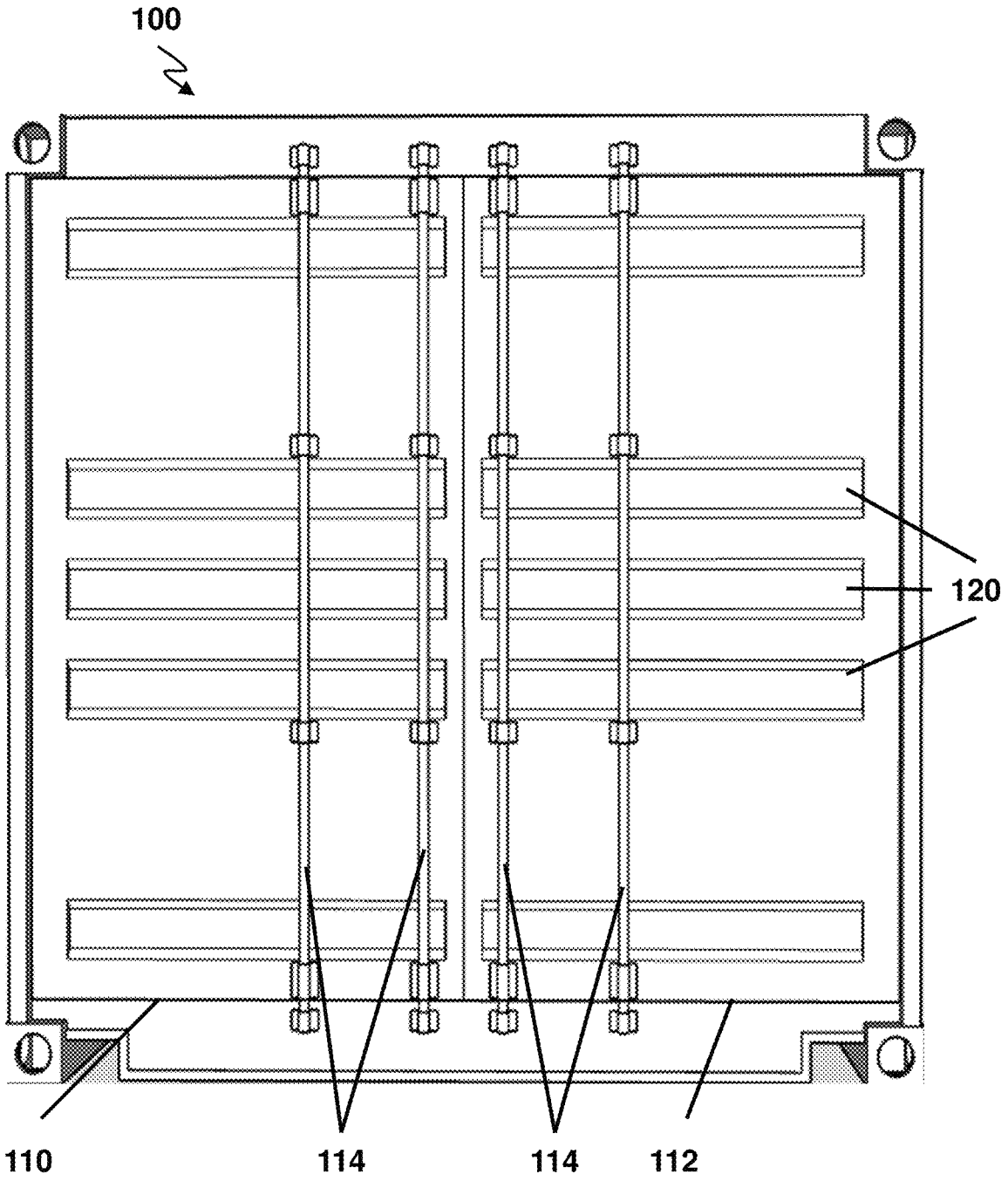
FIG. 1A is a front elevation view of a shipping container capable of being used with the embodiments of the present disclosure.

Reference is now made to FIG. 1A, which shows a shipping container 100 and, in particular, the doors of the shipping container 100. Shipping container 100 has a left door 110 and a right door 112. Further, each door has a plurality of locking rods 114 which typically rotationally engage with a cam structure affixed to the frame of the shipping container.

For strength, typically shipping containers will include corrugations 120 which project from the left door 110 and the right door 112 inward of the shipping container 100.

Figure 1B:
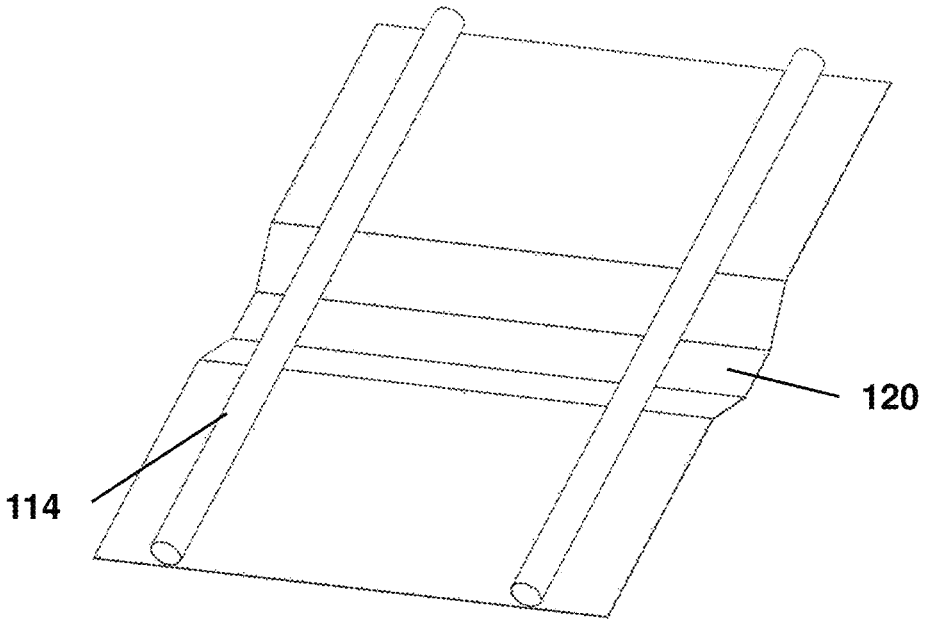
FIG. 1B is a front perspective view of a portion of a container door showing a first configuration for a corrugation in the door.
Figure 1C:
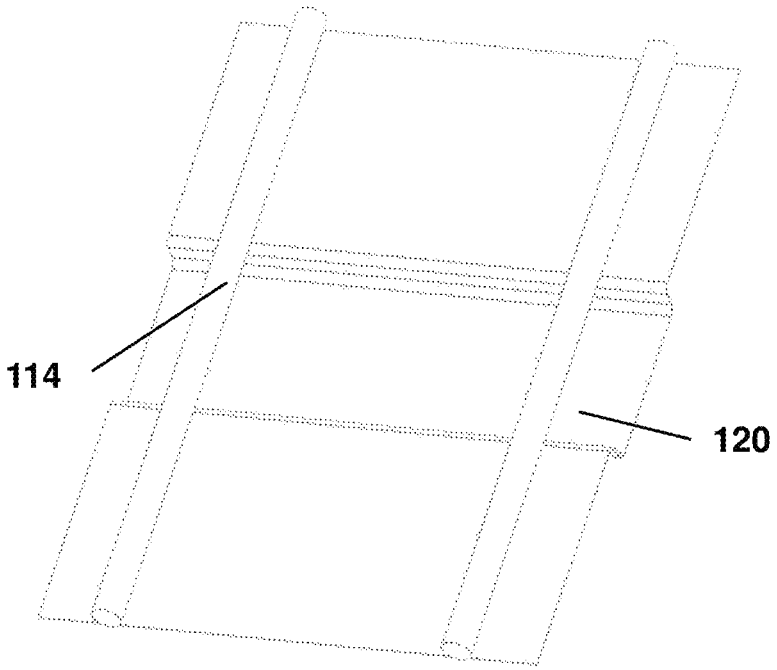
FIG. 1C is a front perspective view of a portion of a container door showing a second configuration for a corrugation in the door.

Corrugations in the door may have various configurations. For example, referring to FIG. 1B, corrugation 120 is shown having a first profile with sloping sides raised to the front surface of the door. Referring to FIG. 1C, the sides of corrugation 120 are shown with more vertical lines extending towards the front surface of the door. Other configurations are possible.

In operation, to open a door on a shipping container 100, a user will rotate the plurality of locking rods 114 on the door to disengage the cam structure on the rod with the brackets on the frame of the shipping container. This unlocks the door which can then be swung open. Similarly, to lock a door on a shipping container 100, the door is closed, and the rods are rotated utilizing a handle until the cam structure on the rod engages the bracket in the frame of the shipping container.

Figure 2:
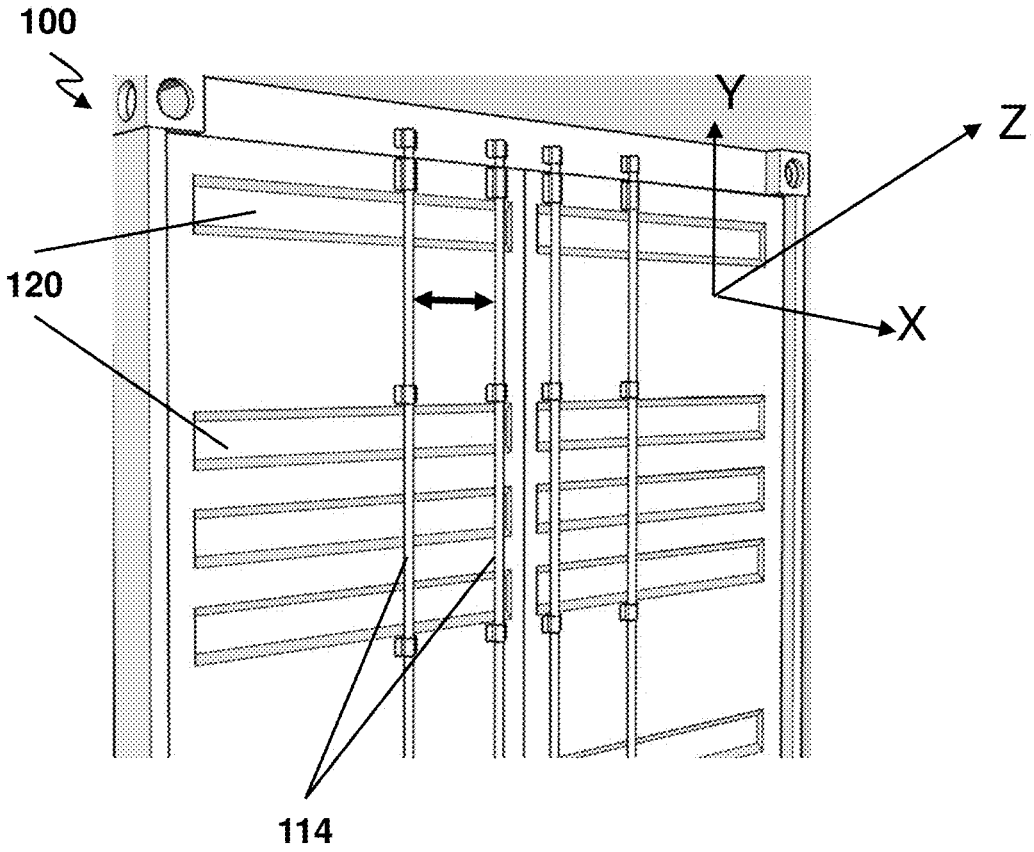
FIG. 2 is a front perspective view of the doors of the shipping container including X, Y and Z axes.

Referring to FIG. 2, this figure shows the shipping container 100 from a perspective view in which X, Y and Z axes that are referred to in the present disclosure are illustrated.

In accordance with one embodiment of the present disclosure, a bracket is provided that may be affixed to a shipping container without use of welding or screws. Reference is made to FIGS. 3 to 7.

Figure 3:
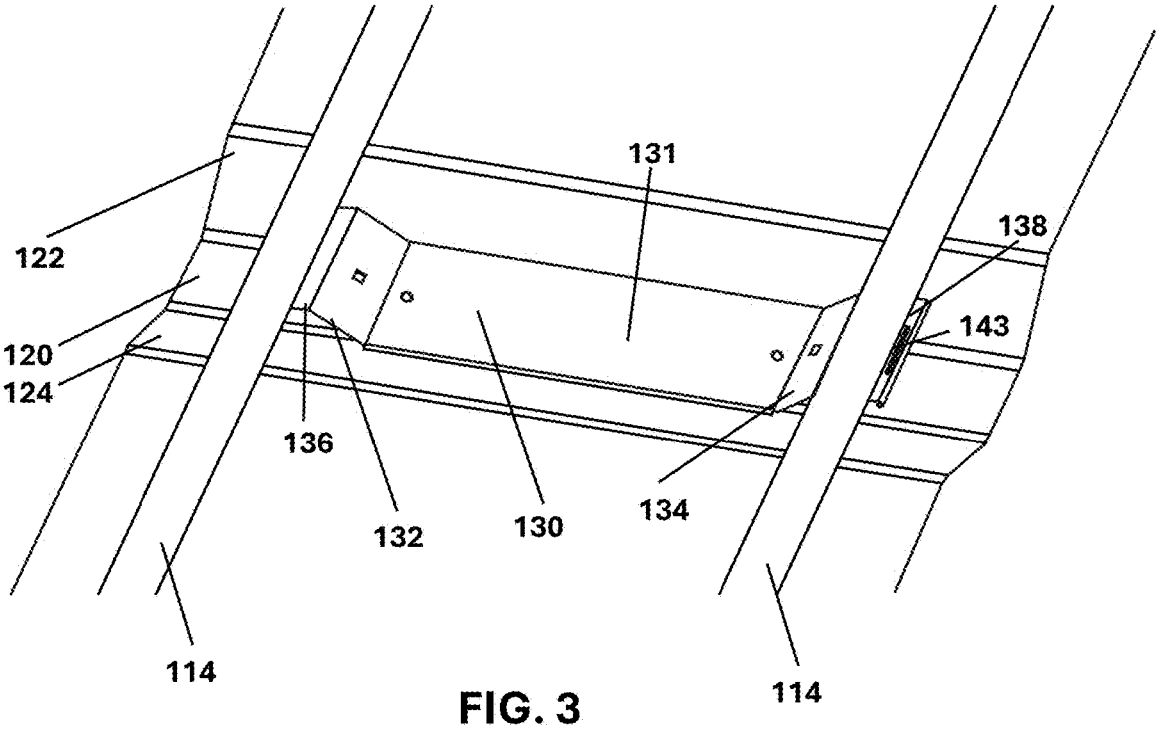
FIG. 3 is a front perspective view of a bracket capable of being used with the embodiments of the present disclosure.
Figure 4:
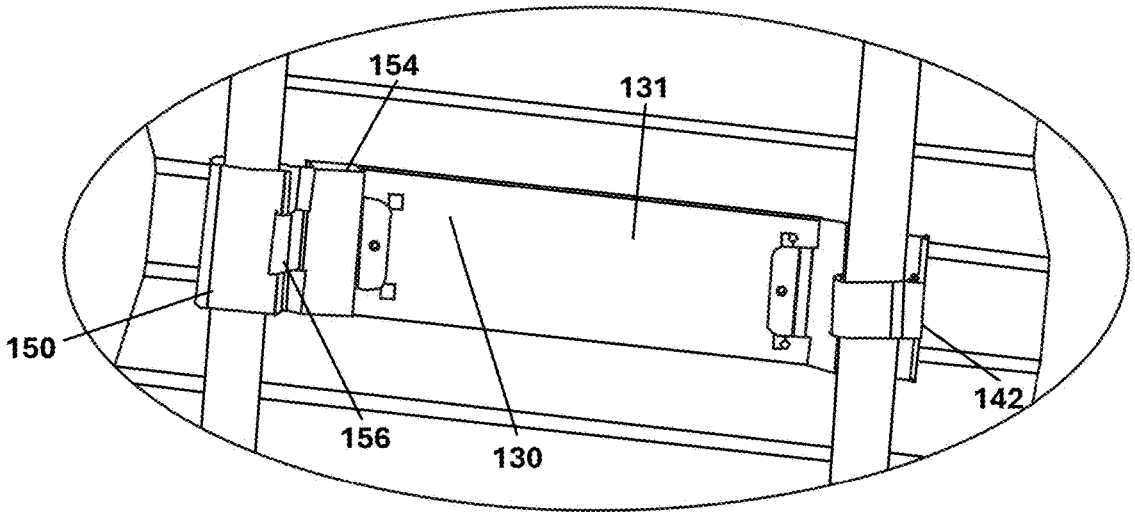
FIG. 4 is a front perspective view of the bracket of FIG. 3 having a cup and locking mechanism.

In the embodiment of FIG. 3, a bracket 130 is configured to fit within the corrugation 120 of the shipping container. Bracket 130 includes a base 131 which may be used to mount equipment in some embodiments, or may be used to affix a mount for equipment in some embodiments.

In the example of FIG. 3, arms 132 and 134 protrude from each end of the base 131 of mounting bracket 130. A first flange 136 extends from arm 132 and is adapted to sit behind a locking rod 114 when bracket 132 is in contact with the corrugation 120. In particular, the corrugation may be wide enough to accommodate bracket 130, in which case, the back of bracket 130 may come into flush contact with a flat portion of corrugation 120. In other cases, corrugation 120 may include a first surface 122 and a second surface 124, which angle towards the front of the door. In this case, an edge of base 131 may make contact with each of surfaces 122 and 124. As is discussed in more detail below, such contact with the flat or angled portions of the corrugation prevents movement in the Z direction and limits rotation about the X and Y axes.

Similarly, a flange 136 extends from arm 134 and is configured to fit behind a second rod 114.

Figure 6:
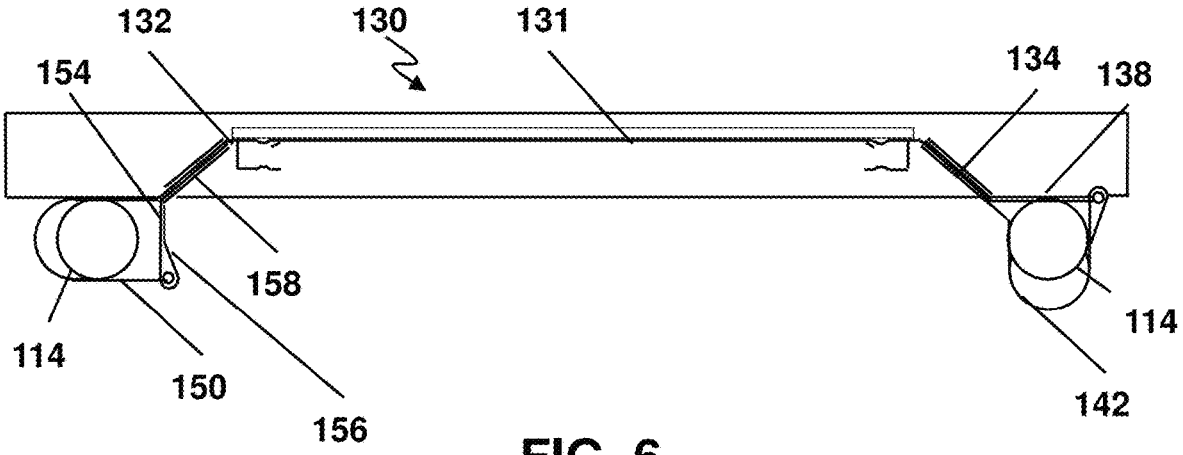
FIG. 6 is a top plan view of a bracket installed on a container.

Bracket 130 may be prevented from movement in the X direction through a variety of techniques. In one embodiment, a locking and positioning mechanism 142, as for example best seen in FIG. 6, is shown. Such locking and positioning mechanism 142 is configured to project from a flange such as flange 138 and to be secured about an arm such as arm 134. For example, as seen in FIG. 3, a slit 143 may be provided within flange 138 to provide a rotation point about which the locking and positioning mechanism 142 may rotate.

Figure 8:
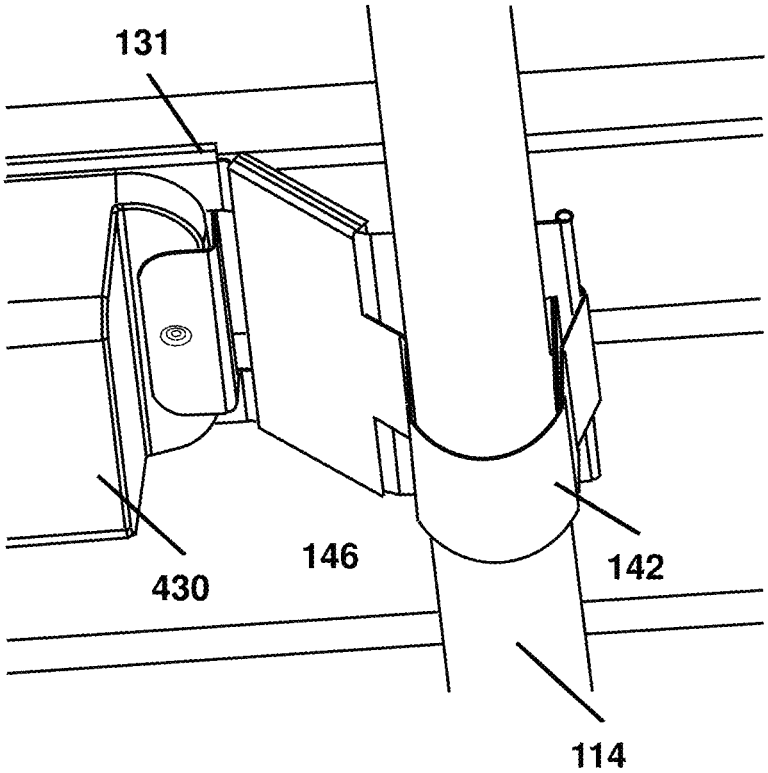
FIG. 8 is a front perspective view of a locking and position mechanism.
Figure 9:
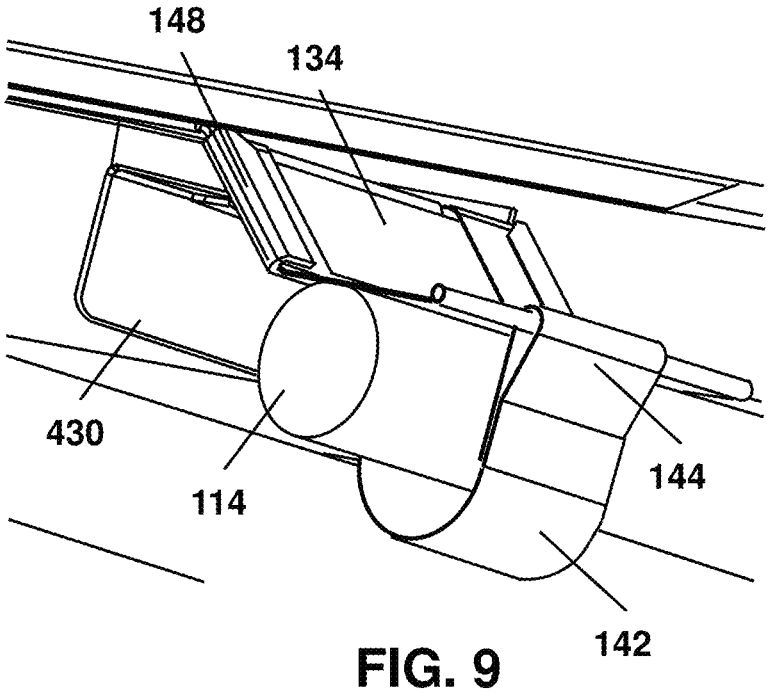
FIG. 9 is a rear perspective view of a locking and positioning mechanism showing engagement with a locking bar.
Figure 10:
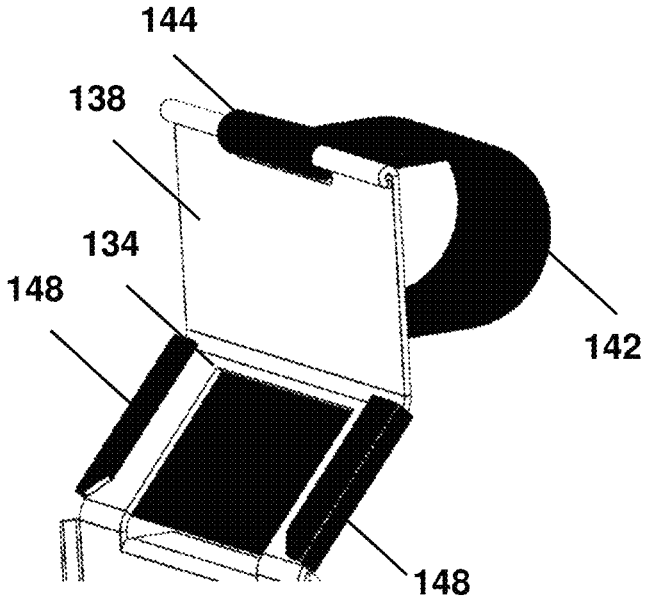
FIG. 10 is a rear perspective view of the locking and positioning mechanism.
Figure 11:
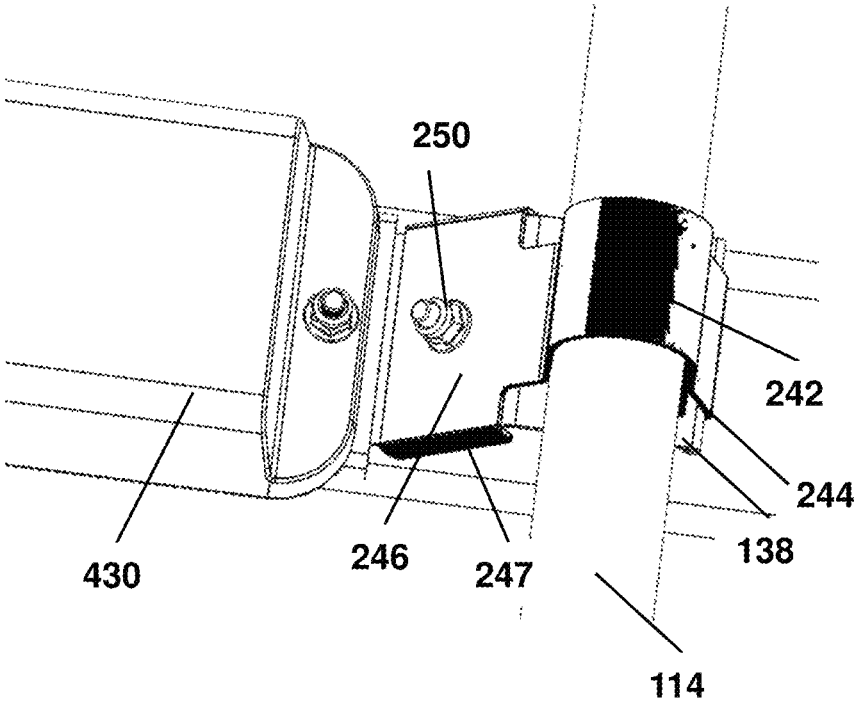
FIG. 11 is a front perspective view of a locking and positioning mechanism utilizing a nut and bolt for attachment.

For example, as seen in FIGS. 8, 9 and 10, a tongue 144 may project through the slit 143 and be secured to itself or another portion of the locking and positioning mechanism 142, either through welding, adhesion, by using mechanical means such as tabs or screws among other options. This may occur either during manufacture of the bracket 130 or during installation, for example.

A second end 146 of the locking and positioning mechanism 142 may then be rotated into contact with arm 134. In this case, tabs 148 at the edges of surface 146 may be bent over arm 134 to hold the locking and positioning mechanism 142 in place.

Installation of bracket 130 in this case involves sliding the bracket within the corrugation 120 and behind the locking rods 114 until the flange 138 is behind a locking rod. Thereafter, the locking and positioning mechanism 142 could be rotated such that surface 146 comes into contact with arm 134. The tabs 148 could then be secured in place behind arm 134 to hold the bracket 130 to the locking rod 114. As will be appreciated, locking rod 114 is still rotatable when the locking and positioning mechanism 142 is secured about such locking rod, thereby ensuring that the doors on the shipping container 100 could still be opened and closed.

In one embodiment, a similar locking and positioning mechanism 142 could be used on the second end of the bracket 142. In this case, flange 136 could have a slit 143 and the tongue 144 of the locking and positioning mechanism 142 could rotatably connect the locking and positioning mechanism to such flange.

Alternatively, at the end of a flange 136, a cup 150 could be provided. This is, for example, best seen in FIGS. 5 and 6. In this case, the cup is used for locking the bracket 130 to the locking rod 114 but due to play in the X direction, the X direction positioning would be mainly restricted based on the locking and positioning mechanism 142.

In some embodiments, cup 150 may include a slit 152 which would accommodate a locking mechanism 154. In this case, locking mechanism 154 includes a tongue 156 and a surface 158, where the tongue could be inserted through the slit of the cup 150 and secured to itself or another portion of the locking mechanism 154, either through welding, tabs, screws, or other similar mechanisms. The locking mechanism 154 would then be rotatable until a surface 158 comes into contact with arm 132. At this point, tabs similar to the tabs shown with regard to the locking and positioning mechanism 142 could be secured about arm 132 to lock the bracket 130 to the locking rod 114.

Figure 5:
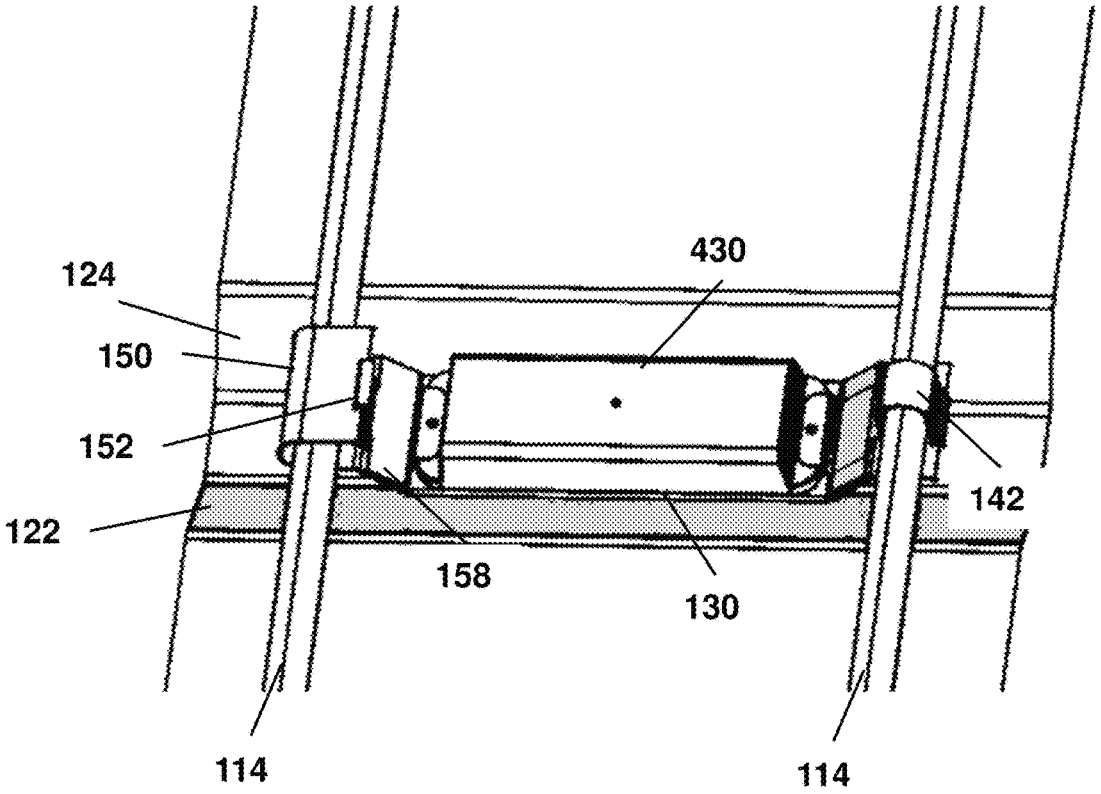
FIG. 5 is a front perspective view of the bracket of FIG. 4 having an electronic device installed thereon.

Using the design of the bracket of FIGS. 5 and 6 with a cup at one side, installation may be accomplished by placing the bracket 130 within the corrugation 120 behind an adjoining pair of locking rods and sliding the bracket such that the cup 150 comes into contact with the first locking rod. At this point, the locking and positioning mechanism 142 may be placed over the second rod and affixed, for example utilizing tabs 148, to arm 134. Further, a locking mechanism 154 may be rotated and the tabs secured about arm 132.

In an alternative embodiment, rather than tabs, the locking and positioning mechanism may be secured to the arm 134 utilizing a nut and bolt. Similarly, the locking mechanism may be secured about arm 132 utilizing a nut and bolt. Reference is now made to FIGS. 11, 12, 13 and 14.

Figure 12:
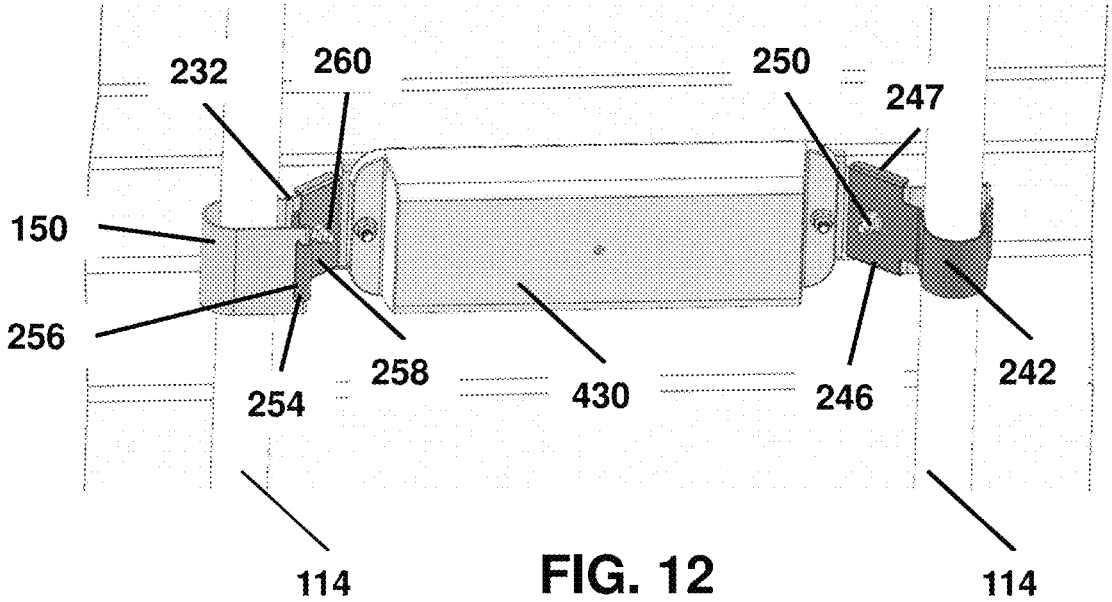
FIG. 12 is a front perspective view of a bracket having the nut and bolt attachment of FIG. 11 with electronic equipment installed thereon.
Figure 13:
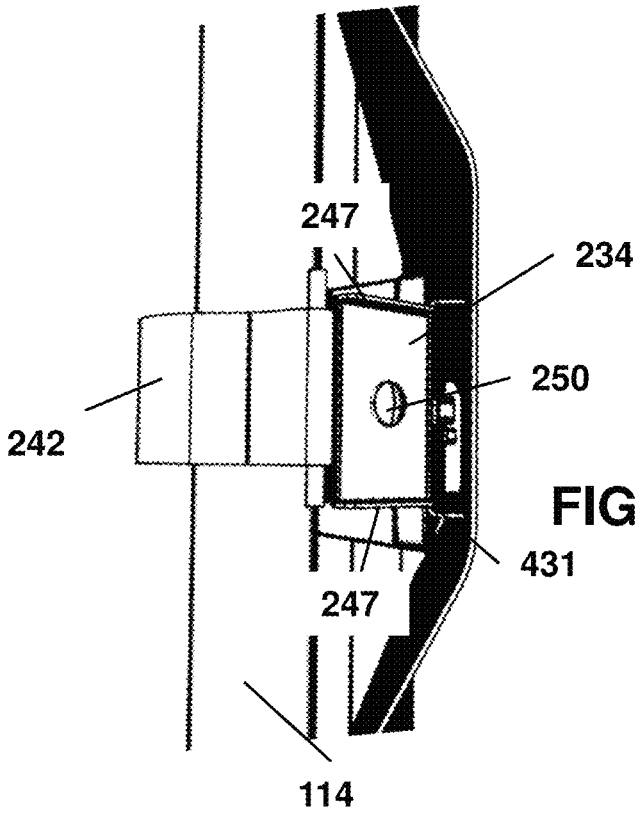
FIG. 13 is a side elevation view of the bracket with the nut and bolt attachment, showing the lower side of the bracket arm.

As seen in the embodiments of FIGS. 12 and 13, when utilizing a nut and bolt, arms 232 and 234 may be the same or may be different then arms 132 and 134 respectively. Specifically, as seen in FIG. 13, arm 234 could be configured with a hole therein to receive the nut and bolt. Similarly, although not shown, arm 232 could have a hole configured to receive the nut and bolt.

A locking and positioning mechanism 242 is configured to interact with a flange 138. In particular, a tongue 244 is configured to fit through a slit 143 within flange 138 and could be secured to itself or another part of the locking and positing mechanism 242, through welding, adhesive, tabs, or nut and bolt, among other options.

When installing the bracket 130, the locking and positioning mechanism 242 can rotate about the end of flange 138 until a surface 246 comes into contact with arm 234. In some embodiments, positioning flanges 247 may be located on either side of surface 246 and be spaced such that they align with the outside of arm 234 to allow the correct positioning of surface 246. However, positioning flanges 247 are optional.

When rotated into position, a hole within surface 246 aligns with a hole in arm 234, thereby allowing a nut and bolt 250 to project through both arm 234 and surface 246 to secure arm 234 and surface 246 together. Once secured, the locking and positioning mechanism 242 holds the bracket 130 to the locking rod 114, while allowing locking rod 114 to rotate therein.

In some embodiments, a locking and positioning mechanism 242 may be used on both sides of bracket 130. In other embodiments, a cup 150 may extend from an arm 232 on bracket 130. This is, for example, best seen in FIG. 14.

Figure 14:
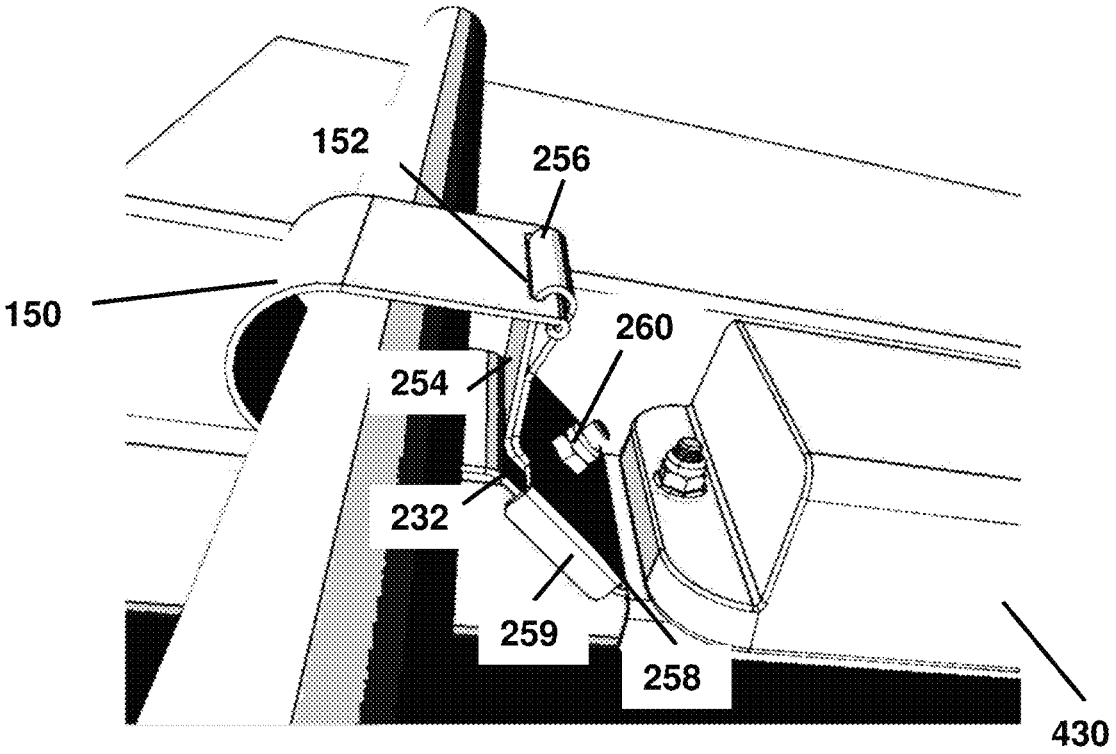
FIG. 14 is a front perspective view of a locking mechanism for a cup having a nut and bolt attachment.

As seen in the embodiment of FIG. 14, a locking mechanism 254 includes a tongue 256 which may extend through a slit 152 within cup 150. The tongue 256 may be secured to itself or to another part of locking mechanism 254, for example through welding, tabs, adhesion, nut and bolt, among other options.

When installing bracket 130, the cup may be slid over a locking bar 114 and the locking mechanism 254 rotated about the end of cup 150 until a surface 258 comes into contact with arm 232. In some cases, positioning flanges 259 may be located on either side of surface 258 to ensure the correct positioning of the surface with regard to arm 232. However, positioning flanges 259 are optional.

A hole within arm 232 may thereby align with a hole within surface 258, allowing a nut and bolt 260 to project through both holes to secure locking mechanism 254 to arm 232.

When secured, bracket 130 is prevented from projecting outwardly from the shipping container by locking rod 114, while locking rod 114 is allowed to rotate within cup 150.

Figure 15:
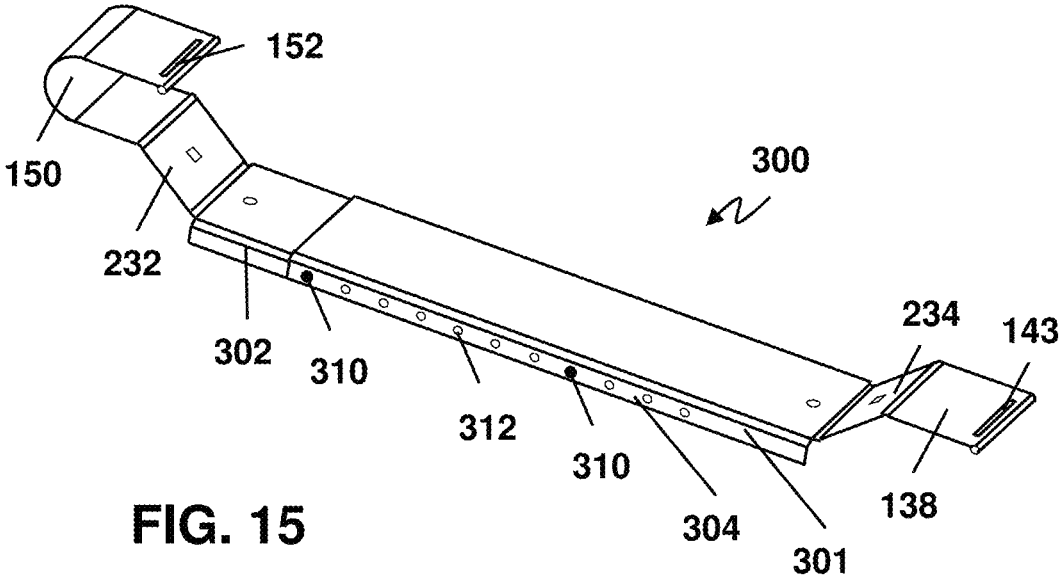
FIG. 15 is a front perspective view of a bracket having a telescoping mechanism therein.

The embodiments of FIGS. 3 to 14 show a fixed length bracket 130 which may be used, for example, on a standard ISO container or if the bracket is made for a particular type of container. However, in some cases, the spacing between adjacent locking rods 114 may vary, and in this case, a bracket having a variable distance between the locking bars may be desired. Reference is now made to FIG. 15.

In the embodiment of FIG. 15, a bracket 300 having a telescoping base 301 is provided. In particular, an inner portion 302 of base 301 is adapted to slide within an outer portion 304 of base 301. In some cases, one or more set screws 310 may be configured to hold inner portion 302 at a certain length within outer portion 304. This is done through a plurality of holes 312 within both the inner portion 302 and the outer portion 304, which may be aligned prior to engaging the set screws 310. In some cases, the holes 312 and set screws 310 may be only engaged on one side of bracket 300. In other cases, the bracket 300 may have holes for set screws 310 on both sides thereof.

In some embodiments, rather than set screws 310, other holding options such as spring clips, brackets, clamps or other mechanisms could be utilized to hold inner portion 302 at a particular length with an outer portion 304.

In some embodiments, no holding options are provided for the base 301.

In the example of FIG. 15, arms 232 and 234 are provided for the bracket 300. However, in other cases arms 132 and 134 or other similar arms could be utilized. Further, the example of FIG. 15 is shown with a cup 150 and a flange 138. However, in other cases, both ends of bracket 300 could include a flange 138. Further, because bracket 300 is telescoping, in other embodiments both sides of bracket 300 could include a cup 150. This may, for example, be used if the cup 150 and locking mechanism therefore provide a positioning fit.

In operation, bracket 300 could be sized to the length of the particular container on which the electronic device is being installed prior to the locking mechanism 254 and the locking and positioning mechanism 242 being engaged. In other cases, the locking mechanism 254 and locking and positioning mechanism 242 could be engaged prior to the set screws 310 being fixed. Other options are possible.

Figure 16:
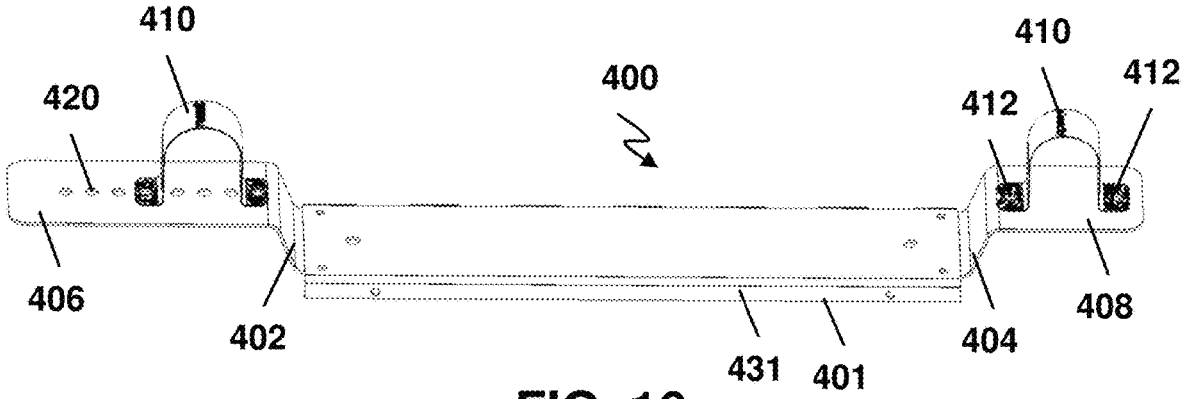
FIG. 16 is a front perspective view of a bracket having varied mounting points for a positioning and locking mechanism.
Figure 17:
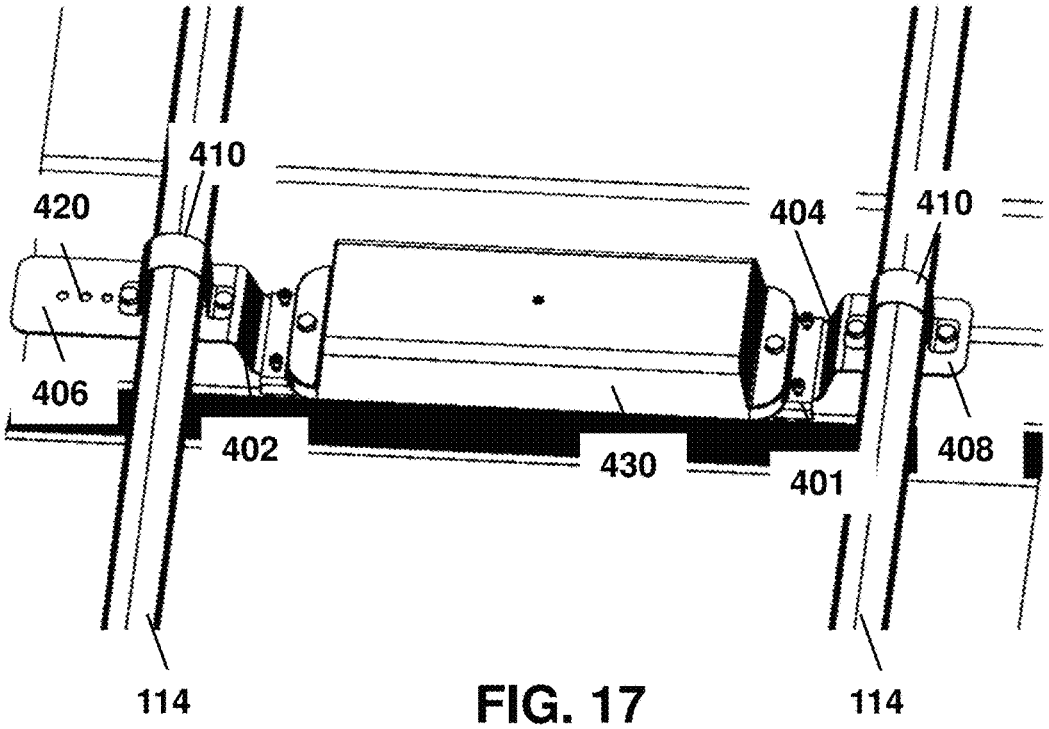
FIG. 17 is a front perspective view of the bracket of FIG. 16 mounted to a shipping container with equipment thereon.

In still a further embodiment, rather than a telescoping bracket 300, a fixed bracket with a variable engagement mechanism may be utilized. Reference is now made to FIGS. 16 and 17. In the example of FIGS. 16 and 17, a bracket 400 is provided. Bracket 400 has a base 401 and includes arms 402 and 404. A flange 406 protrudes from the end of arm 402 and a flange 408 protrudes from the end of arm 404.

In the example of FIGS. 16 and 17, flange 408 includes two holes for securing a locking and positioning mechanism 410 thereto. In particular, ends 412 of locking and positioning mechanism 410 are configured to align the holes of the locking and positioning mechanism 410 with the holes on flange 408.

The same locking and positioning mechanism 410 may be used in some cases on flange 406. In other embodiments, different locking and positioning mechanisms may be used on the opposite sides of bracket 400.

For example, in some embodiments, rather than two holes, locking and positioning mechanism 410 could be rotationally affixed to flange 408 in a similar manner to locking and positioning mechanism 142.

A plurality of holes 420 are provided on flange 406 to allow for the variation in the spacing between adjoining locking rods 114.

In operation, the bracket 400 could be slid into the corrugation 120 and locking and positioning mechanism 410 could be affixed to flange 408. Thereafter, the locking and positioning mechanism 410 on the other side of bracket 400 could be affixed over the locking rod 114 to flange 406 utilizing the holes 420.

In some embodiments, if the positioning of the electronic device between adjacent locking rods is desired with more precision, a flange 406 could be used on both sides of bracket 400, thereby allowing the electronic device to be positioned more precisely in the X axis.

Further, in another embodiment, the bracket 300 from FIG. 15 could be combined with the bracket 400 from the embodiment of FIG. 16. For example, the telescoping base 301 portion of bracket 300 could be used for gross adjustment while the plurality of holes in flange 406 could be used for fine adjustment.

Other options are possible.

In operation, bracket 130, 300 or 400, once secured, ensure that an electronic device 430 affixed thereto is securely held in place, minimizing movement and rotation. Specifically, the electronic device 430 fits within corrugation 120 and is positioned behind the front surface of locking rods 114, thereby protecting the electronic device 430.

Movement in the X axis is prevented by locking and positioning mechanism 142, 242 or 410.

Movement in the Z axis is prevented by a combination of the flanges 136, 138, 406, or 408, or cup 150 on a surface of locking rod 114 when combined with pressure of the bracket against shipping container 100. This may be achieved in several ways.

Figure 7:
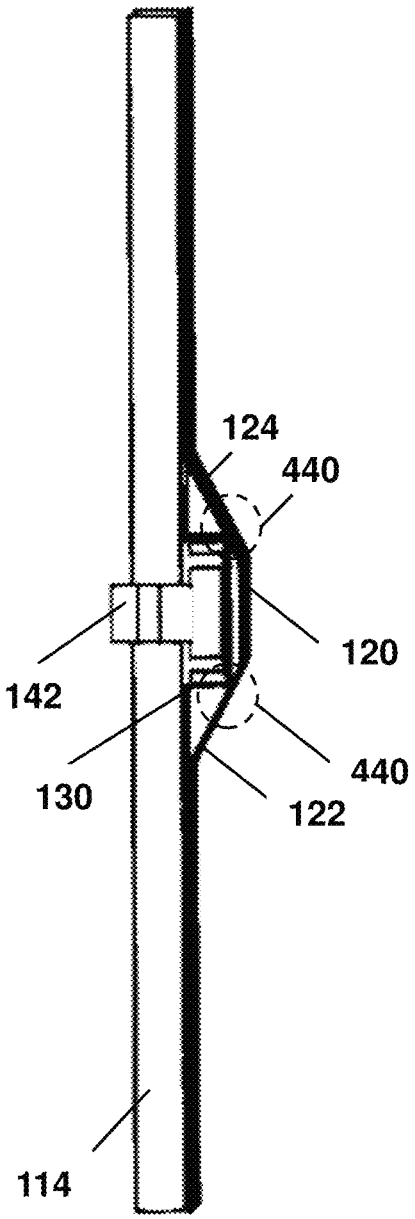
FIG. 7 is a side elevational view of a bracket installed on a container.

In one embodiment the bracket 130, 300 or 400 is configured to sit flush within the interior of a corrugation 120. In other cases, bracket 130, 300 or 400 could be dimensioned to engage the angled surfaces 122 and 124 of corrugation 120, for example at points 440 as shown in FIG. 7.

Arms 132, 134, 232, 234, 402 or 404 could be dimensioned and angled to ensure that the bracket 130, 300 or 400 is in contact with the shipping container 100. The bracket 130, 300 or 400 could have a rearwardly facing flanges to lift the bracket from the surface of the shipping container. This is for example shown with flanges 431 in the embodiments of the FIGS. 13 and 16. Flanges 431 provide the extra advantage of allowing the electronic device 430 to be screwed or bolted to the bracket and allowing the screw or bolt to project rearward of the base without coming into contact with the shipping container 100.

In some cases, the length of flanges 431 could vary based on the type of shipping container that bracket 130, 300 or 400 is configured to be used for.

For brackets 300 and 400, as these brackets are telescoping, another option for providing a solid contact between the locking bars and the corrugation 120 (whether a flat portion or angled surfaces 122 and 124) is a variable angle on arms 132, 134, 232, 234, 402 or 404. Specifically, if the joint between the base 301 or 401 and the arms, along with the joint between the arms and the flanges provides some flexibility, then the depth of the brackets 300 or 400 between an electronic device mounting surface and the surface of flanges 136, 138, 406 or 408 could be varied.

Figure 18:
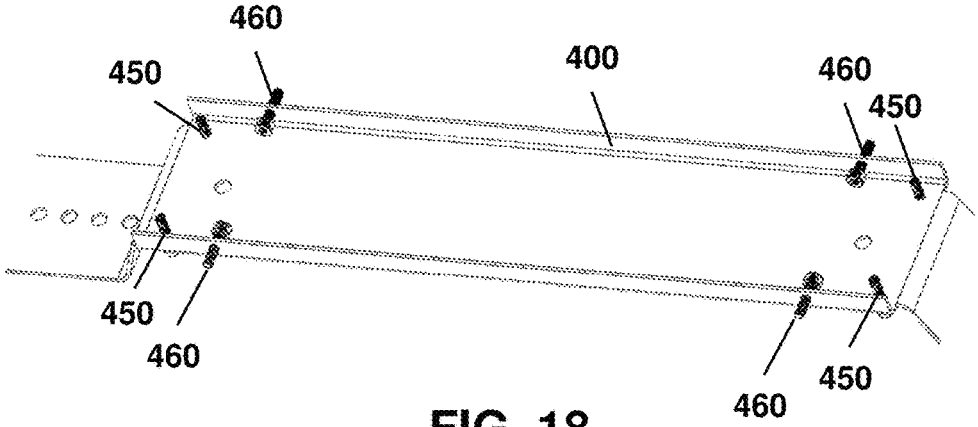
FIG. 18 is a rear perspective view of a bracket showing adjustment screws for adjusting the positioning of the bracket.

In some embodiments, height adjusting or tensioning screws 450, as best seen in FIG. 18, could be used. Such screws could be adjusted before or after the bracket is affixed to the locking rods 114 to ensure a tight fit for the bracket between the locking rods 114 and the shipping container 100. While the embodiment of FIG. 18 shows the height adjusting or tensioning screws 450 associated with bracket 400, such screws could be equally used with brackets 130 or 300.

In some cases, height adjusting or tensioning screws 450 could further include footers (not shown) to prevent damage to the shipping container.

Therefore, by using one or a combination of the length and angle of the bracket arms, height adjusting or tensioning screws, and/or flange heights on the rear of the bracket, movement of the bracket in the Z axis between the lock bars and the shipping container is minimized or prevented.

Movement in the Y axis may be minimized based on gravity and a surface 122 of the shipping container. In particular, the base of bracket 130, 300 or 400 may engage surface 122. This may occur whether bracket 130, 300 or 400 sits flush against corrugation 120 or has engagement with an angled portion of surface 122. In some embodiments the prevention of movement downwards in the Y axis may be sufficient.

In other cases, the bracket may engage a portion of both surface 122 and 124, thereby preventing movement in both directions in the Y axis.

In still further embodiments, if the bracket is not wide enough in the Y axis, then adjustment screws 460, as for example seen in FIG. 18, could be used to engage one or both of surfaces 122 or 124. Such adjustment screws 460 may be adjusted prior to installation of the bracket 400. In some cases, adjustment screws 460 may include a footer (not shown) to prevent damage to the shipping container 100.

Further, while the embodiment of FIG. 18 shows the adjustment screws 460 used with bracket 400, such adjustment screws could equally be used with brackets 130 or 300.

Further, while the embodiment of FIG. 18 shows both adjusting or tensioning screws 450 and adjustment screws 460, in some cases only one of the two types of screws may be provided with a bracket 130, 300 or 400.

In some embodiments, rather than or in addition to screws 450 or 460, shims or other padding could be used with the brackets.

Based on the above, a bracket 130, 300 or 400 could be affixed to a shipping container for mounting an electronic device thereon, where the electronic device is secured to the container and restricted from moving in the X, Y and Z axes.

Further, the electronic device would be stable from yaw, pitch or roll based on the attachment to the shipping container. Specifically, the engagement of the bracket between the corrugation 120 or surfaces 122 and 124 and the locking rods 114 prevents any rotation along any axis.

As such, vibration and movement of the electronic device is minimized which allows for electronic devices to operate properly and without damage.

The device 430 could be mounted to bracket 130, 300 or 400 in a variety of ways. In some embodiments, base 131, 301 or 401 could be formed or provided with mounting mechanisms integral thereto. For example, a hole may exist on either end of base 131, 301 or 401 through which a nut and bolt could be projected to secure equipment or device 430 to the bracket. In some cases, the hole could be threaded to allow for a screw rather than a nut and bolt. In some cases, if the base 301 is telescoping, a plurality of holes could be provided in the base to allow the equipment to be mounted when the base 301 is telescoped to different sizes. Other options are possible.

In still further cases, as described below, the electronic device could be held to the base utilizing a u-shaped bend. For example, on a vehicle, the screws may loosen over time, which may cause vibration and damage of the device. In this regard, a dimple on a U-shaped bend, along with tabs, may be used to hold the device to the bracket.

As provided above, the mount may be integral with the base 131, 301 or 401 in some embodiments. In some embodiments, the mount may be configured to be affixed to the base 131, 301 or 401, for example through screws, welding or adhesive, among other options. In still other embodiments, a mount may be configured to be applied directly to the shipping container, for example through screws, welding or adhesive, among other options. Reference is now made to FIGS. 19 to 27 which show example mounts for electronic devices or other devices.

Figure 19:
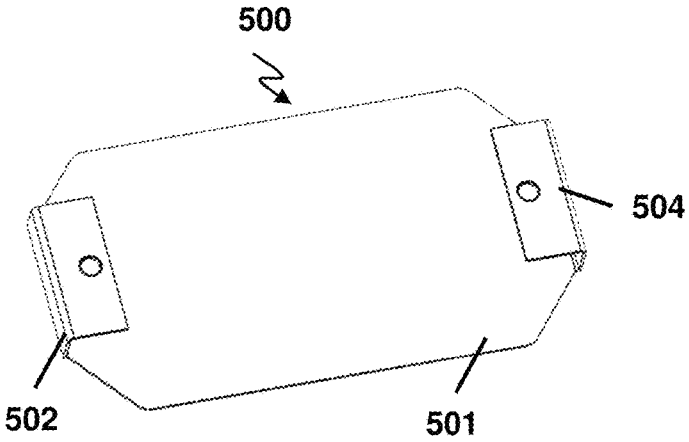
FIG. 19 is a top perspective view of an example mount for an electronic device capable of being used but the embodiments of the present disclosure.
Figure 20:
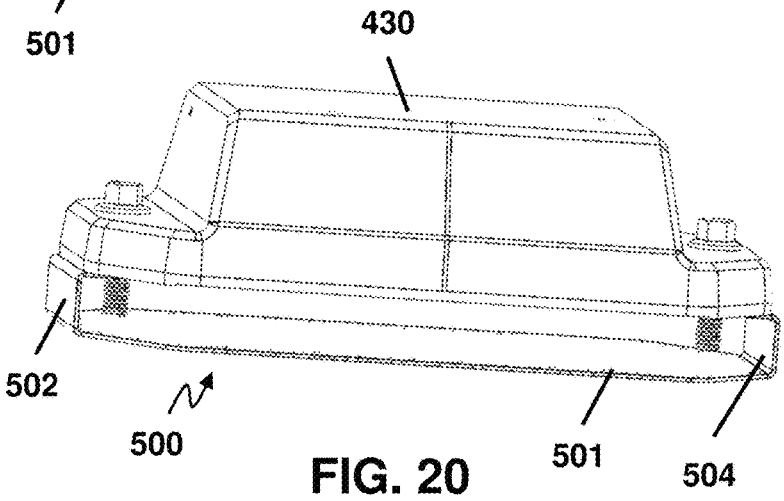
FIG. 20 is a side perspective view of the mount of FIG. 19.
Figure 24:
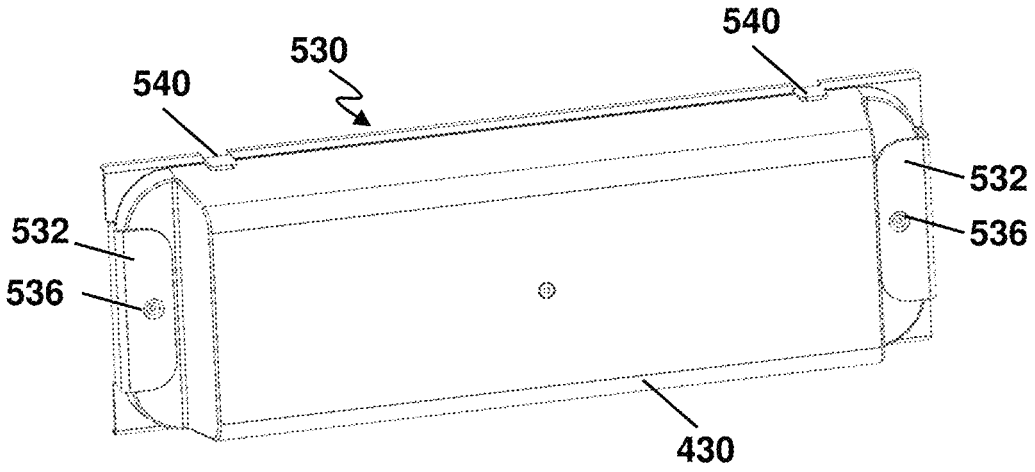
FIG. 24 is a front perspective view of a mount for a differently shaped device.
Figure 25:
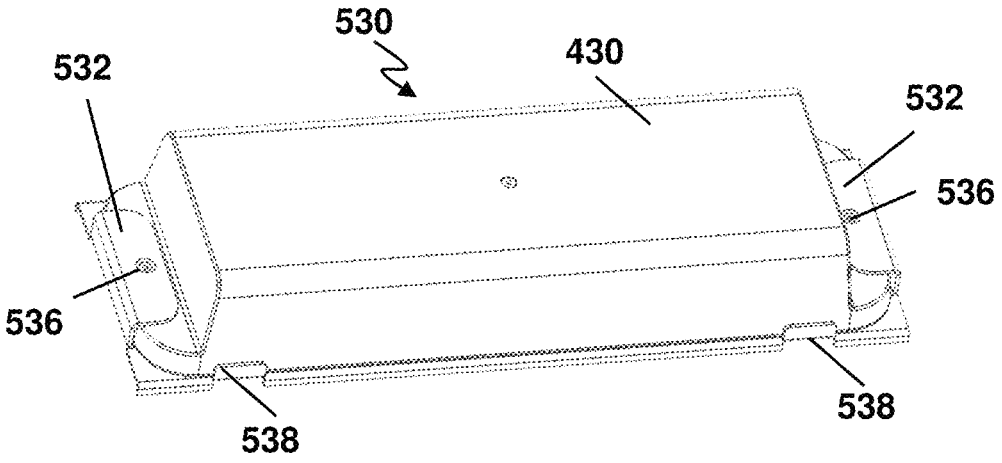
FIG. 25 is a lower perspective view of the mount of FIG. 24.

Referring to FIGS. 19 and 20, a mount 500 includes a first U-shaped bend 502 and a second U-shaped bend 504. In one embodiment, the electronic device may be mounted by inserting projections on the electronic device behind the U-shaped bend 502 and 504 and inserting a screw or bolt through a hole therein. In some cases, the hole could project through a base 501 for use of a bolt. This may for example, occur in situations where mount 500 is either integral to or connected to a bracket which has flanges below its base to accommodate the nut or head of the bolt.

In some cases, the screw may not proceed all the way through the electronic device and may therefore not require a hole in the base 501. This could be used in the case where mount 500 is integral to the base of the bracket, the mount 500 is affixed to the base of the bracket, or the mount 500 is affixed directly to the shipping container.

In another embodiment, is best seen in FIG. 20, the electronic device 430 could be mounted on the outside of the U-Shaped bend. In this case, a screw or bolt could project through the electronic device into the mount using a hole in the U-shaped bend 502 and 504. This could be used in the case where mount 500 is integral to the base of the bracket, the mount 500 is affixed to the base of the bracket, or the mount 500 is affixed directly to the shipping container.

Rather than screws, nuts or bolts, in some cases tension and tabs may be used to hold the device in place. Reference is now made to FIGS. 21, 22 and 23.

In the embodiments of FIGS. 21, 22 and 23, a mount 510 is provided. Mount 510 includes a base 511, along with a U-shaped bend 512 on each side of the mount.

Each U-shaped bend 512 includes a dimple 516 therein. The dimple is configured to fit within a screw hole on the electronic device and to resiliently hold the electronic device between the base 511 and the top of the U-shaped bend 512. Specifically, the material tension of the U-shaped bend is used to hold the device 430 in the Z direction. Unlike a screw, this dimple will never come loose. Further, dimple 516 will automatically be centered within the screw hole, causing accurate positioning of the device in X-Y directions.

Tabs 518 and 520 may optionally in some cases be provided. For example, in one embodiment, tabs 518 may be bent prior to equipment installation. The electronic device 430 or other device may be installed by sliding the device into the mount 510 from the top so that projections at each end of the device 430 fit within the U-shaped bend 512 until the dimple 516 engages with the screw hole in the electronic device and the electronic device comes into contact with tabs 518. At this point, tabs 520 may be bent to hold the electronic device 430 in place.

In other embodiments, tabs 518 could be bent during equipment installation.

In other embodiments, tabs 520 could be omitted.

Elements of mount 510 could be integral with brackets 130, 300, 400 in some embodiments. For example, the base could be created with u-shaped bend 512 and tabs 518.

In some embodiments, mount 510 could be a separate component from the base and be affixed to a base 131, 301, or 401, for example using screws, bolts, adhesive, welding, among other options. The choice for the method for affixing the mount may in some cases reflect characteristics of the device to be mounted, such as the size or weight of the device. For example, in some cases the device may be too heavy to have adhesive used for affixing the mount.

In some embodiments, mount 510 could be affixed directly to shipping container 100, for example using screws, bolts, adhesive, welding, among other options. The choice for the method for affixing the mount may in some cases reflect characteristics of the device to be mounted, such as the size or weight of the device. For example, in some cases the device may be too heavy to have adhesive used for affixing the mount.

Different shapes and configurations of electronic equipment could be accommodated by a mount. For example, in the embodiments of FIGS. 24 and 25, a mount 530 is provided. Mount 530 includes a U-shaped bend 532 on each side of the mount.

Each U-shaped bend 532 includes a dimple 536 therein. The dimple is configured to fit within a screw hole on the electronic device and to resiliently hold the electronic device within the U-shaped bend 532. Specifically, the material tension of the U-shaped bend is used to hold the device 430 in the Z direction. Unlike a screw, this dimple will never come loose. Further, dimple 536 will automatically be centered within the screw hole, causing accurate positioning of the device in X-Y directions.

Tabs 538 and 540 may optionally in some cases be provided. For example, in one embodiment, tabs 538 may be bent prior to equipment installation. The electronic device 430 or other device may be installed by sliding the device into the mount 530 from the top so that tabs at each end of the device 430 fit within the U-shaped bend 532 until the dimple 536 engages with the screw hole in the electronic device and the electronic device comes into contact with tabs 538. At this point, tabs 540 may be bent to hold the electronic device 430 in place.

In other embodiments, tabs 538 could be bent during equipment installation.

In other embodiments, tabs 540 could be omitted.

Elements of mount 530 could be integral with brackets 130, 300, 400 in some embodiments. This may occur if U-shaped bend 532 and tabs 538 are provided as part of the base, for example.

In some embodiments, mount 530 could be a separate component from the base and be affixed to a base 131, 301, or 401, for example using screws, bolts, adhesive, welding, among other options.

In some embodiments, mount 530 could be affixed directly to shipping container 100, for example using screws, bolts, adhesive, welding, among other options.

In some cases, electronic equipment may need to be tilted in order to function properly. One option for a tilt is provided with regard to the mounts shown in FIGS. 26 and 27.

Figure 26:
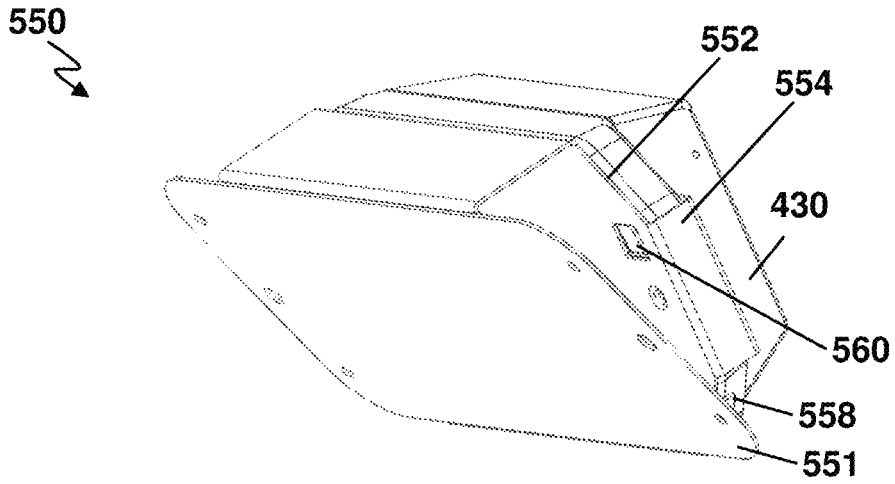
FIG. 26 is a lower perspective view of an angled mount.
Figure 27:
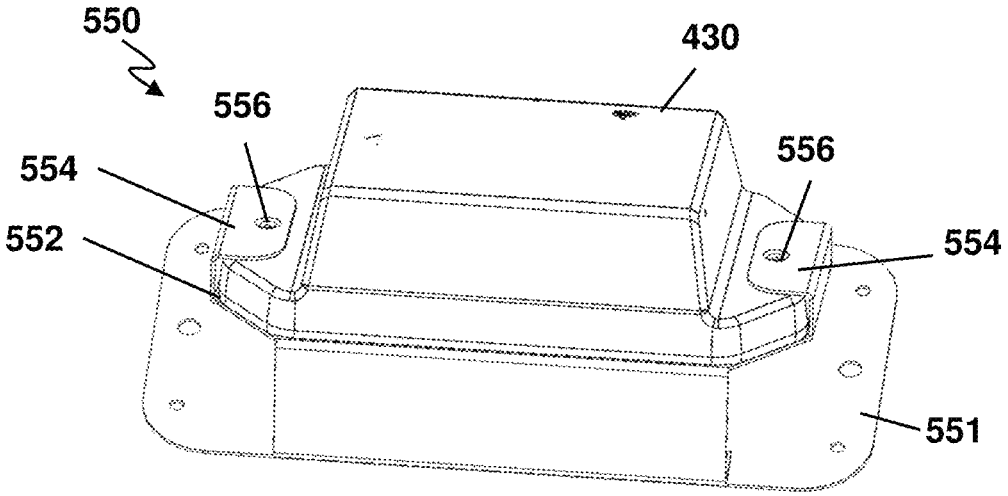
FIG. 27 is an upper perspective view of the angled mount of FIG. 26.

In the embodiments of FIGS. 26 and 27, a mount 550 includes a first base 551 and a second base 552, where the second base 552 is raised away from base 551 and tilted with respect thereto. The angle of the tilt could be adapted for the particular equipment that is being installed in some cases. In other cases, a height adjustment mechanism could be provided to allow for variable tilt.

Equipment 430 can be mounted to second base 552. In the example of FIGS. 26 and 27, the mounting is done through U-shaped bends 554 with a dimple 556 therein, as described with regards to the embodiments of FIGS. 21 to 25 above. A tab 558 could be provided to hold the electronic device in place.

In some embodiments, a spring clip 560 could be provided to hold the electronic device in place.

While the embodiments of FIGS. 26 and 27 utilize the U-shaped bend and dimple, in other cases the electronic device could be held through screws, nuts or bolts, among other options.

Elements of mount 550 could be integral with brackets 130, 300, 400 in some embodiments. In some embodiments, mount 550 could be a separate component from the base and be affixed to a base 131, 301, or 401, for example using screws, bolts, adhesive, welding, among other options. In some embodiments, mount 550 could be affixed directly to shipping container 100, for example using screws, bolts, adhesive, welding, among other options.

In still a further embodiment of the present disclosure, a bracket for mounting an electronic or other device could be configured to fit tightly within a corrugation 120 and to rest behind at least one locking rod 114. For example, such bracket may be made utilizing plastic injection molding or aluminum extrusion, in some cases. In some cases, the bracket could be made through sheet metal folding. In some cases, the bracket could be made in two or more parts which may be joined together, for example through welding, adhesive, mechanical means such as screws or bolts come among other options.

Figure 28:
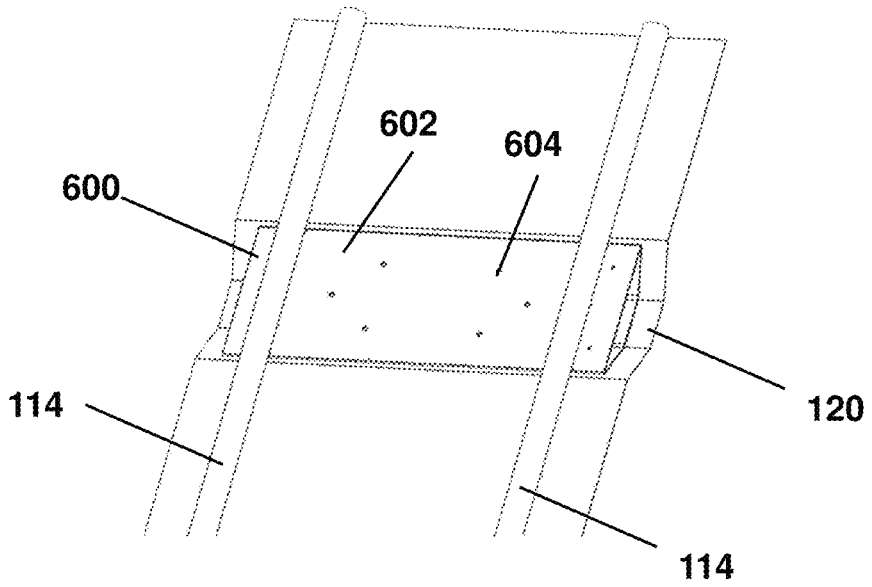
FIG. 28 is a front perspective view of a door corrugation having a bracket configured to fit therein.
Figure 29:
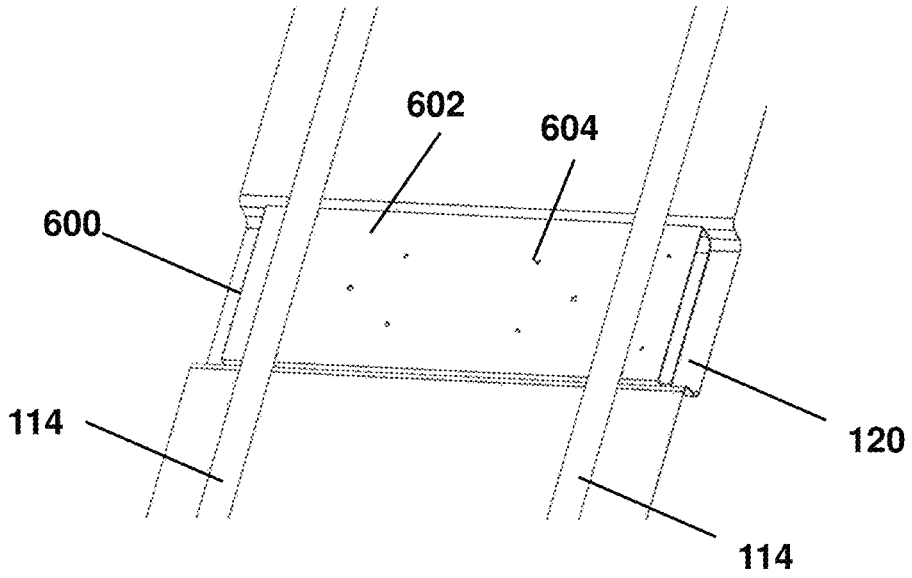
FIG. 29 is a front perspective view of a door corrugation with a second profile having a bracket configured to fit therein.

Reference is now made to FIGS. 28 and 29. In the embodiments of FIGS. 28 and 29, two shapes of corrugation 120 are shown. The bracket 600 is configured to fit within the shape of the corrugation of an intended shipping container the bracket is to be mounted on. For example, have seen in FIG. 28, bracket 600 has edges that slope at more of an angle then the bracket within FIG. 29.

In some embodiments, the bracket 600 may be of similar shape to the corrugation. In other cases, the bracket 600 may be configured to fit within the corrugation where only a portion of the bracket 600 fits against at least one of the sides of the corrugation.

Bracket 600 further includes a surface 602 for use in mounting an electronic device. In some cases, the electronic device may be mounted to holes 604 that are predrilled into bracket 600. However, in other cases, the electronic device may be mounted by creating holes, for example utilizing self tapping screws, or by drilling on site and using screws or nuts. In still further cases, a mounting bracket such as that described above with regard to FIGS. 19 to 27 could be mounted onto bracket 600 prior to mounting the electronic device. Other options for mounting are also possible.

In some embodiments, using brackets 600, a low profile electronic device may be used so that the electronic device sits behind the front surface of locking rods 114. In other cases, the electronic device may extend past the front of the locking rods 114.

In some embodiments, bracket 600 may include rubber feet or stoppers, as well as rubber surfaces to fit under locking rods 114. Such rubber feet and surfaces may reduce motion of bracket 600 and further cushion bracket 600 from vibrations in some cases.

The mounting bracket 600 may be held to the shipping container in a variety of ways. Reference is now made to FIGS. 30 to 35.

Figure 30:
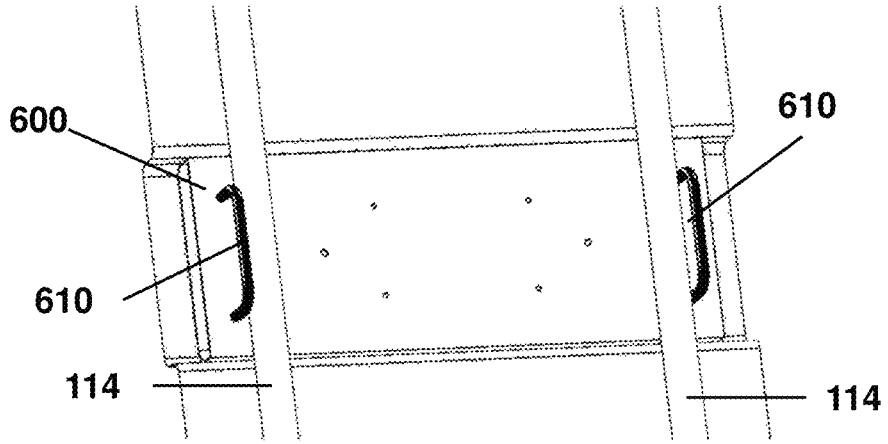
FIG. 30 is a front perspective view of a bracket shaped to fit within a door corrugation having a first securing mechanism.

Referring to FIG. 30, in one embodiment the bracket 600 may be held in place utilizing a pair of stoppers 610. In particular, stoppers 610 could be mounted on bracket 600 once a bracket 600 is fitted behind locking rods 114 within corrugation 120. Each stopper could be mounted to the outside or the inside of the locking rod to prevent motion of bracket 600 in the X direction.

In the embodiment of FIG. 30, the stopper 610 is shown as a U-shaped bar that could be affixed to bracket 600 using nuts or other locking mechanisms. In some embodiments, stopper 610 may have a flange that is adapted to rest against the front surface of bracket 600 to provide support when a nut is affixed within a centre of bracket 600.

In other embodiments, stopper 610 may be affixed through spring clips or other locking mechanisms. For example, the stopper 610 could use a similar mechanism to a U-shaped bicycle lock in which the bracket may be placed into a first hole and rotated into a second hole, where it could be locked. The first hole could have a tongue extending therein to prevent removal of the bracket from the first hole.

Other options for securing stopper 610 to bracket 600 are possible.

In other embodiments, stopper 610 could be other shapes, including a solid flange, one or more poles or rods protruding from bracket 600, or other similar shapes.

Figure 31:
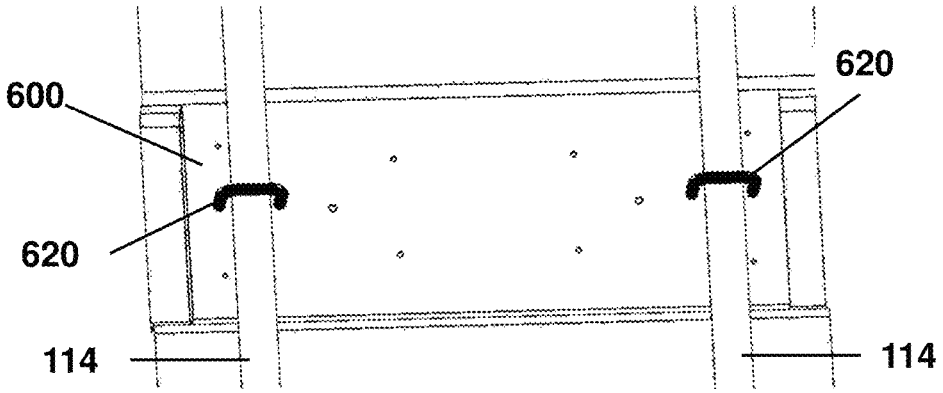
FIG. 31 is a front perspective view of a bracket shaped to fit within a door corrugation having a second securing mechanism.

Referring to FIG. 31, in another embodiment, bracket 600 may be secured to the shipping container utilizing clamps 620. For example, clamps 620 may be a u-shaped bolt that fits over the locking rod 114 and may be secured to bracket 600 utilizing nuts, for example. in some cases, clamp 620 may include a flange or a nut and washer to sit on the surface of bracket 600 when a nut is secured from within bracket 600. This configuration may for example create a space between the clamp and locking rod 114 to facilitate rotation of locking rod 114. However, such flange or washer is optional.

The embodiment of FIG. 31 includes a single clamp 620 on each side of bracket 600. However, in other cases, multiple clamps could be provided on each side of bracket 600.

Figure 32:
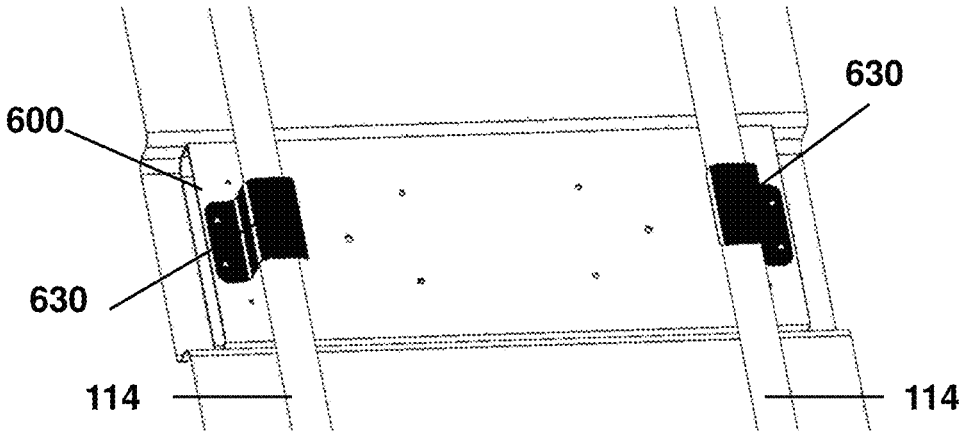
FIG. 32 is a front perspective view of a bracket shaped to fit within a door corrugation having a first securing mechanism.

In still a further embodiment, clamps could be secured to bracket 600 on only one side of the locking rod 114. This is for example shown in FIG. 32. In the embodiment of FIG. 32, a clamp 630 is adapted to sit over locking rod 114 and be secured to the bracket 600 at one side of the locking rod, for example utilizing screws, nuts, bolts, among other options. Clamps 630 would be installed after bracket 600 is placed behind locking rods 114 within a corrugation 120.

Further, in some embodiments, different securing mechanisms could be used on different ends of bracket 600. For example, reference is now made to FIGS. 33 to 35.

Figure 33:
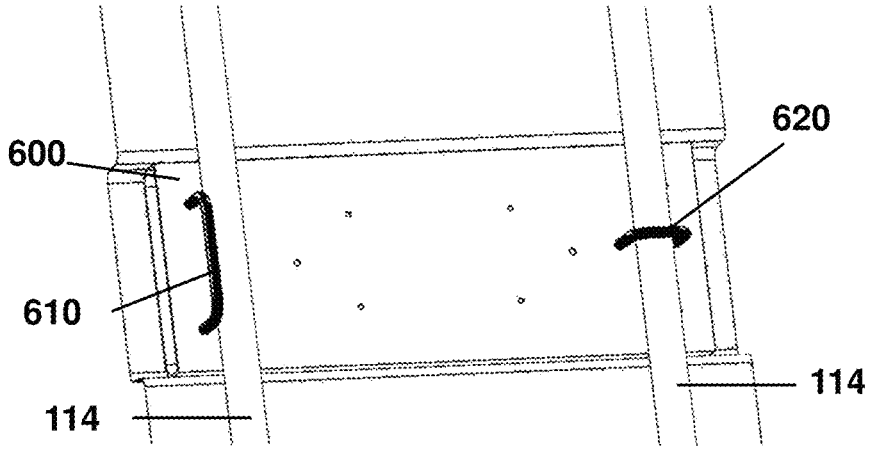
FIG. 33 is a front perspective view of a bracket shaped to fit within a door corrugation having both a first and second securing mechanism.

In the example of FIG. 33, bracket 600 is secured utilizing a stopper 610 at a first end thereof and a clamp 620 at a second end thereof.

Figure 34:
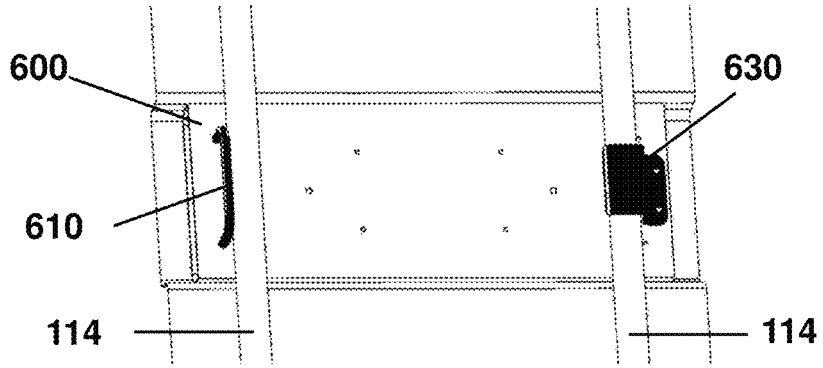
FIG. 34 is a front perspective view of a bracket shaped to fit within a door corrugation having both a first and third securing mechanism.

In the example of FIG. 34, bracket 600 is secured utilizing a stopper 610 at a first end thereof and a clamp 630 at a second end thereof.

Figure 35:
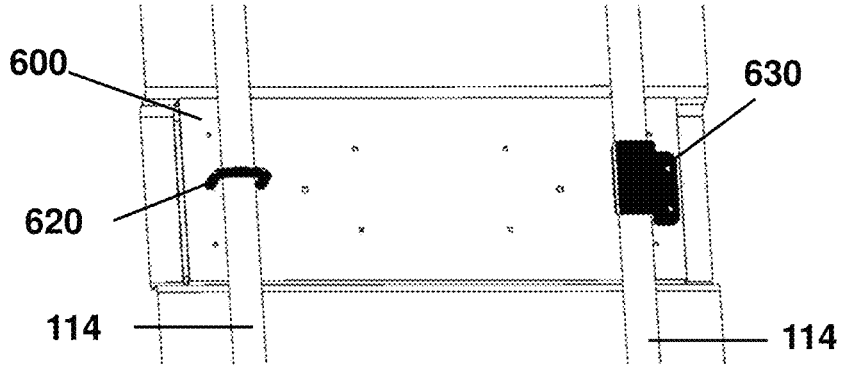
FIG. 35 is a front perspective view of a bracket shaped to fit within a door corrugation having both a second and third securing mechanism.

In the example of FIG. 35, bracket 600 is secured utilizing a clamp 620 at a first end thereof and a clamp 630 at a second end thereof.

Other options for securing bracket 600 to the shipping container are possible.

In a further embodiment, a bracket may not be necessary for mounting the electronic device to the shipping container. For example, reference is now made to FIGS. 36 to 38.

Figure 36:
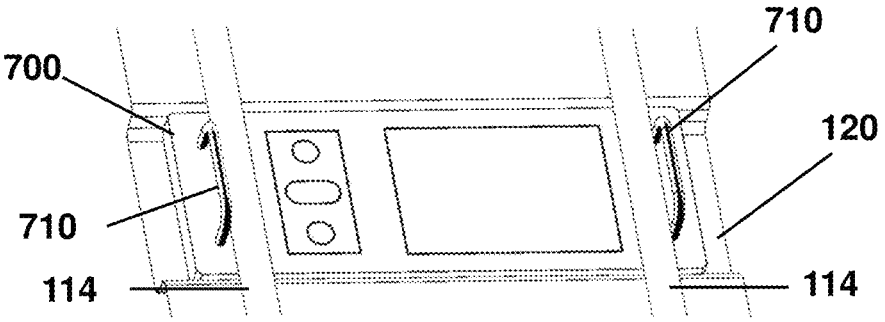
FIG. 36 is a front perspective view of an electronic device shaped to fit within a door corrugation having a first securing mechanism.
Figure 37:
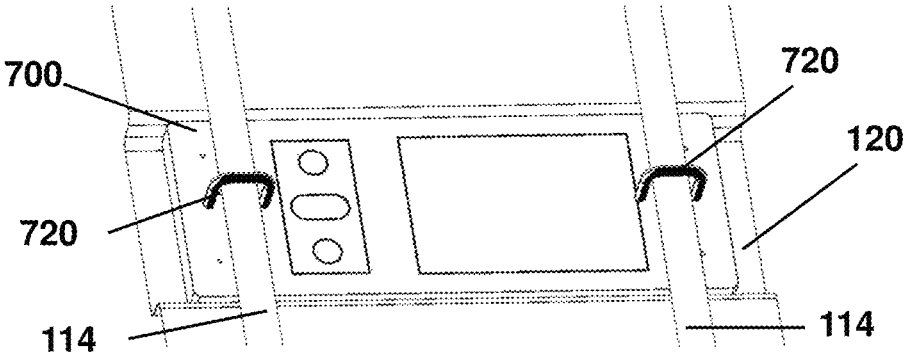
FIG. 37 is a front perspective view of an electronic device shaped to fit within a door corrugation having both a first and second securing mechanism.
Figure 38:
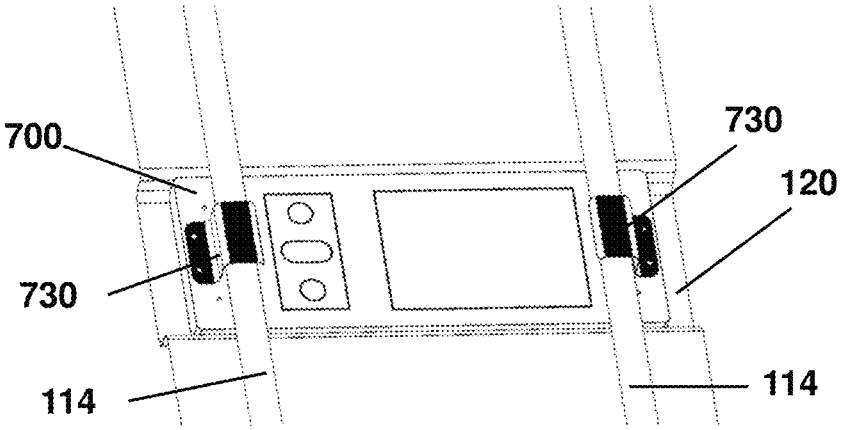
FIG. 38 is a front perspective view of an electronic device shaped to fit within a door corrugation having both a first and third securing mechanism.

In the embodiments of FIGS. 36 to 38, the device (for example an electronic device) may be shaped to fit securely within a corrugation 120 on a shipping container. Therefore, device 700 is shaped such that the depth of the device 700 is generally the same depth as the distance between the rear of a locking rod 114 and the bottom of corrugation 120.

In some embodiments, the device 700 may be of similar shape to the corrugation. In other cases, the device may be configured to fit within the corrugation where only a portion of the device 700 fits against at least one of the sides of the corrugation 120.

Device 700 may include rubber feet in some cases below the device to grip the shipping container and provide for vibration control. In some embodiments, device 700 may include a rubber backing to sit between the device and the locking rod 114.

Referring to FIG. 36, in one embodiment the device 700 may be held in place utilizing a pair of stoppers 710. In particular stoppers 710 could be mounted on device 700 once device 700 is fitted behind locking rods 114 within corrugation 120. Each stopper could be mounted to the outside or the inside of the locking rod to prevent motion of device 700 in the X direction.

In the embodiment of FIG. 36, the stopper 710 is shown as a U-shaped bar that could be affixed to device 700. However, other configurations for stopper 710 are possible.

Referring to FIG. 37, in another embodiment, device 700 may be secured to the shipping container utilizing clamps 720. For example, clamps 720 may be a u-shaped bolt that fits over the locking rod 114 and may be secured to device 700.

The embodiment of FIG. 37 includes a single clamp 720 on each side of device 700. However, in other cases, multiple clamps could be provided on each side of device 700.

In still a further embodiment, clamps could be secured to device 700 on only one side of the locking rod 114. This is for example shown in FIG. 38. In the embodiment of FIG. 38, a clamp 730 is adapted to sit over locking rod 114 and be secured to the device 700 at one side of the locking rod, for example utilizing screws, nuts, bolts, among other options. Clamps 730 would be installed after device 700 is placed behind locking bars 114 within a corrugation 120.

Brackets 130, 300, 400 and 600 and mounts 500, 510, 530 and 550 could be formed of any resilient material including, but not limited to, metal, plastic, or other suitable engineered material. The choice of material will depend on the application and the requirements for bonding the brackets and/or mounts to each other or the shipping container.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Also, techniques, systems, subsystems, and methods described and illustrated in the various implementations as discrete or separate may be combined or integrated with other systems, modules, techniques, or methods. Other items shown or discussed as coupled or directly coupled or communicating with each other may be indirectly coupled or communicating through some interface, device, or intermediate component, whether electrically, mechanically, or otherwise. Other examples of changes, substitutions, and alterations are ascertainable by one skilled in the art and may be made.

While the above detailed description has shown, described, and pointed out the fundamental novel features of the disclosure as applied to various implementations, it will be understood that various omissions, substitutions, and changes in the form and details of the system illustrated may be made by those skilled in the art.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

The invention claimed is:

1. A bracket for affixing a device to a shipping container, the bracket comprising:

a base;

a first arm and a second arm disposed on distal ends of the base;

a first flange and second flange extending from the first arm and the second arm;

a first affixing mechanism and a second affixing mechanism to affix the first flange and the second flange respectively to adjacent locking rods on the shipping container, said first affixing mechanism and second affixing mechanism allowing rotation of the locking rods; and a mounting mechanism on the base for mounting the device, wherein the base is configured to fit within a corrugation behind the adjacent locking rods, and at least one portion of the base is configured to contact the shipping container when the first flange and the second flange are behind the adjacent locking rods.

2. The bracket of claim 1, wherein the first affixing mechanism comprises a flange extending from the first arm, and a locking and positioning mechanism rotatable connected to the flange, wherein the locking and positioning mechanism is rotatable over one of the adjacent locking rods and is configured to affix to the first arm.

3. The bracket of claim 2, wherein the locking and positioning mechanism is configured to affix utilizing at least one of: folding tabs at an end of the locking and positioning mechanism to fold over the first arm; and a hole in a surface at the end of the locking and positioning mechanism aligning with a hole in the arm and a bolt and nut being affixed therethrough.

4. The bracket of claim 1, wherein the second flange comprises a cup at the end of the second arm configured to slide over one of the adjacent locking rods, the second affixing mechanism comprising a lock rotatably engageable at an end of said cup.

5. The bracket of claim 1, wherein the base is telescoping.

6. The bracket of claim 1, wherein the base is configured to sit flush within the corrugation of the shipping container.

7. The bracket of claim 1, wherein a lower edge of the base is configured to engage a lower sloped surface of the corrugation and an upper edge of the base is configured to engage an upper sloped surface of the corrugation when the bracket is affixed behind the adjacent locking rods.

8. The bracket of claim 1, wherein the base includes tensioning screws projecting rearwardly of the base, the tensioning screws configured cause the base to move away from the shipping container when adjusted, thereby increasing pressure on the first flange and the second flange with the adjacent locking rods.

9. The bracket of claim 1, where the base includes adjusting screws to increase a width of the bracket.

10. The bracket of claim 1, wherein the first flange has a plurality of holes to receive a locking and positioning mechanism based on a spacing between the adjacent locking rods.

11. The bracket of claim 1, wherein the base includes a mounting mechanism comprising:

a first u-shaped bend configured to receive a first mounting portion of the device;

a first dimple configured to project into a screw hold within the first mounting portion;

a second u-shaped bend a second mounting portion of the device;

a second dimple configured to project into a screw hold within the second mounting portion; and a plurality of tabs, wherein the first dimple and second dimple position the device in an X axis and a Y axis and wherein the plurality of tabs prevent movement of the electronic device.

12. The bracket of claim 11, wherein the mounting mechanism is one of: affixed to the base; or integral to the base.

13. The bracket of claim 1, wherein the base includes a mounting mechanism comprising:

a first u-shaped bend configured to receive a first mounting portion of the device, the first u-shaped bend having a hole to receive a screw therein; and a second u-shaped bend configured to receive a second mounting portion of the device, the second u-shaped bend having a hole to receive a screw therein;

wherein the electronic device is positioned under or over the first u-shaped bend.

14. The bracket of claim 1, wherein the base includes a mounting mechanism comprising:

a first base plate; and a second base plate, the second base plate being angled to the first base plate to mount the electronic device at an angle to the shipping container.

15. A bracket for affixing a device to a shipping container, the bracket comprising:

a base shaped to securely fit within a corrugation on the shipping container behind adjacent locking rods on the shipping container;

a first affixing mechanism and a second affixing mechanism to affix the device to the adjacent locking rods on the shipping container, said first affixing mechanism and second affixing mechanism allowing rotation of the locking rods; and a mounting mechanism on the base for mounting the device.

16. The bracket of claim 15, wherein the base is extruded or injection molded to fit within the corrugation.

17. The bracket of claim 15, wherein the first affixing mechanism is at least one of:

a stopper configured to sit adjacent one of the locking rods;

a u-shaped clamp configured to fit over one of the locking rods; and a clamp configured to be affixed on one side of one of the locking rods and extend over the one of the locking rods.

18. The bracket of claim 17, wherein the second affixing mechanism is at least one of:

a stopper configured to sit adjacent a second of the locking rods;

a u-shaped clamp configured to fit over the second of the locking rods; and a clamp configured to be affixed on one side of the second of the locking rods and extend over the second of the locking rods.

19. The bracket of claim 15, wherein the mounting mechanism includes predrilled holes in a surface of the base to secure the device.

20. The bracket of claim 15, further comprising:

rubber feet affixed to the base and configured to rest between the base and the corrugation; and rubber stopper affixed to a front surface of the base and configured to rest between the base and each of the adjacent locking rods.

* * * * *